US011802342B2

(12) United States Patent
Abel

(10) Patent No.: US 11,802,342 B2
(45) **Date of Patent: *Oct. 31, 2023**

(54) METHODS FOR WET ATOMIC LAYER ETCHING OF RUTHENIUM

(71) Applicant: Tokyo Electron Limited, Tokyo (JP)

(72) Inventor: Paul Abel, Austin, TX (US)

(73) Assignee: Tokyo Electron Limited, Tokyo (JP)

( * ) Notice: Subject to any disclaimer, the term of this patent is extended or adjusted under 35 U.S.C. 154(b) by 52 days.

This patent is subject to a terminal disclaimer.

(21) Appl. No.: 17/674,579

(22) Filed: Feb. 17, 2022

(65) Prior Publication Data

US 2023/0118554 A1 Apr. 20, 2023

Related U.S. Application Data

(60) Provisional application No. 63/257,226, filed on Oct. 19, 2021.

(51) Int. Cl.
*C23F 1/30* (2006.01)

(52) U.S. Cl.
CPC ..... *C23F 1/30* (2013.01)

(58) Field of Classification Search
CPC ... C23F 1/30; C23F 1/40; C23C 22/02; C23G 1/20
See application file for complete search history.

(56) References Cited

U.S. PATENT DOCUMENTS 5,374,328 A 12/1994 Remba et al.
6,616,014 B1 9/2003 Pozniak et al.
6,841,031 B2 1/2005 Iwata et al.
6,896,600 B1 5/2005 Wu et al.
7,683,021 B2 3/2010 Shea et al.
8,597,769 B2 12/2013 Takaya et al.
10,157,756 B2 12/2018 Yamada
10,982,335 B2 4/2021 Abel
2002/0004303 A1 1/2002 Agnello
2003/0087528 A1 5/2003 Kruwinus
2006/0289389 A1 12/2006 Shea
2009/0007938 A1 1/2009 Dubreuil et al.
2009/0047790 A1 2/2009 Raghu et al.
(Continued)

FOREIGN PATENT DOCUMENTS

KR 1020170022922 3/2017
KR 1020170077839 7/2017
(Continued)

OTHER PUBLICATIONS

International Search Report and The Written Opinion; PCT/US2022/077672, dated Jan. 27, 2023, 11 pgs.
(Continued)

*Primary Examiner* — Binh X Tran
(74) *Attorney, Agent, or Firm* — Egan, Enders & Huston LLP.

(57) ABSTRACT

The present disclosure provides a new wet atomic layer etch (ALE) process for etching ruthenium. More specifically, the present disclosure provides various embodiments of methods that utilize new etch chemistries for etching ruthenium in a wet ALE process. Unlike conventional etch processes for ruthenium, the wet ALE process described herein for etching ruthenium is metal-free, cost-effective and improves surface roughness during etching.

24 Claims, 12 Drawing Sheets

(56) References Cited

U.S. PATENT DOCUMENTS

| | | | | |
|---|---|---|---|---|
| 2010/0279435 | A1 | 11/2010 | Xu et al. | |
| 2011/0094888 | A1 | 4/2011 | Chen et al. | |
| 2012/0031768 | A1 | 2/2012 | Reid et al. | |
| 2014/0199840 | A1 | 7/2014 | Bajaj et al. | |
| 2014/0370643 | A1 | 12/2014 | Stern et al. | |
| 2016/0089686 | A1 | 3/2016 | Lee et al. | |
| 2016/0141210 | A1 | 5/2016 | Lei et al. | |
| 2016/0372320 | A1 | 12/2016 | Emoto | |
| 2017/0194196 | A1 | 7/2017 | Brink et al. | |
| 2017/0356084 | A1 | 12/2017 | Nakanishi et al. | |
| 2018/0090352 | A1 | 3/2018 | Sotoku et al. | |
| 2018/0226278 | A1 | 8/2018 | Arnepalli et al. | |
| 2018/0374936 | A1 | 12/2018 | Kelly et al. | |
| 2019/0011734 | A1 | 1/2019 | Otsuji | |
| 2019/0027383 | A1 | 1/2019 | Nakal et al. | |
| 2019/0148192 | A1 | 5/2019 | Yamaguchi | |
| 2019/0295856 | A1* | 9/2019 | Tahara | H01L 21/67248 |
| 2020/0161148 | A1* | 5/2020 | Abel | C23F 1/12 |
| 2020/0377792 | A1* | 12/2020 | Guske | C09K 13/02 |
| 2023/0117790 | A1* | 4/2023 | Abel | H01L 21/32134 438/758 |
| 2023/0121246 | A1* | 4/2023 | Abel | C23F 1/30 216/108 |

FOREIGN PATENT DOCUMENTS

| | | | |
|---|---|---|---|
| WO | 2017099718 | | 6/2017 |
| WO | WO-2017099718 | A1 * | 6/2017 |
| WO | 2017205658 | | 11/2017 |
| WO | 2018004649 | | 1/2018 |

OTHER PUBLICATIONS

International Search Report issued in Application No. PCT/US2019/061683, dated Mar. 13, 2020, 9 pgs.

International Search Report Issued in Application No. PCT/US2019/061678, dated Mar. 13, 2020, 8 pgs.

* cited by examiner

700

METHODS FOR WET ATOMIC LAYER ETCHING OF RUTHENIUM

This application claims priority to U.S. Provisional Patent Application Ser. No. 63/257,226, filed Oct. 19, 2021, entitled "METHOD FOR WET ATOMIC LAYER ETCHING OF RUTHENIUM"; the disclosure of which is expressly incorporated herein, in their entirety, by reference. This application is related to co-pending U.S. patent application Ser. No. 17/674,593, entitled "RUTHENIUM CMP CHEMISTRY BASED ON HALOGENATION," which is commonly owned and filed on the same day therewith.

BACKGROUND

This disclosure relates to semiconductor device manufacturing, and, in particular, to the removal and etching of polycrystalline materials, such as metals. During routine semiconductor fabrication, various metals formed on a substrate may be removed by patterned etching, chemical-mechanical polishing, as well as other techniques. A variety of techniques are known for etching layers on a substrate, including plasma-based or vapor phase etching (otherwise referred to as dry etching) and liquid based etching (otherwise referred to as wet etching). Wet etching generally involves dispensing a chemical solution over the surface of a substrate or immersing the substrate in the chemical solution. The chemical solution often contains a solvent, chemicals designed to react with materials on the substrate surface and chemicals to promote dissolution of the reaction products. As a result of exposure of the substrate surface to the etchant, material is removed from the substrate. Etchant composition and temperature may be controlled to control the etch rate, specificity, and residual material on the surface of the substrate post-etch.

Thermodynamics and kinetics both play roles in etchant formulation. The desired reactions need to be both thermodynamically and kinetically favorable for a successful etch. The requirements for success become much more stringent for etching polycrystalline materials. For these materials, it is desirable that the removal rates for each individual crystallite facet and grain boundary geometry is substantially similar regardless or crystallite morphology or environment. Surface roughness plays an important role in interface quality and electrical properties of nanoscale features. When etching nanoscale polycrystalline materials, differing etch rates at grain boundaries compared to the different crystal facets leads to roughening of the surface during etching. Further, it is desirable that the material removal rate should be uniform at the macroscopic and microscopic levels and occurs at a rate that is compatible with high volume manufacturing. Macroscopic uniformity can be addressed with careful engineering, but microscopic uniformity depends on the chemistry of the etch itself.

As geometries of substrate structures continue to shrink and the types of structures evolve, the challenges of etching substrates have increased. One technique that has been utilized to address these challenges is atomic layer etching (ALE). ALE is a process that removes thin layers sequentially through one or more self-limiting reactions. For example, ALE typically refers to techniques that can etch with atomic precision, i.e., by removing material one or a few monolayers of material at a time. ALE processes generally rely on a chemical modification of the surface to be etched followed by a selective removal of the modified layer. Thus, ALE processes offer improved performance by decoupling the etch process into sequential steps of surface modification and removal of the modified surface. In some embodiments, an ALE process may include multiple cyclic series of layer modification and etch steps, where the modification step modifies the exposed surfaces and the etch step selectively removes the modified layer. In such processes, a series of self-limiting reactions may occur and the cycle may be repeatedly performed until a desired or specified etch amount is achieved. In other embodiments, an ALE process may use just one cycle.

A variety of ALE processes are known, including plasma ALE, thermal ALE and wet ALE techniques. Like all ALE processes, wet ALE is typically a cyclic process that uses sequential, self-limiting reactions to selectively remove material from the surface. Unlike thermal and plasma ALE, however, the reactions used in wet ALE primarily take place in the liquid phase. Compared to other ALE processes, wet ALE is often desirable since it can be conducted at (or near) room temperature and atmospheric pressure. Additionally, the self-limiting nature of the wet ALE process leads to smoothing of the surface during etching rather than the roughening commonly seen during other etch processes.

A wet ALE process typically begins with a surface modification step, which exposes a material to a first solution to create a self-limiting modified surface layer. The modified surface layer may be created through oxidation, reduction, ligand binding, or ligand exchange. Ideally, the modified surface layer is confined to the top monolayer of the material and acts as a passivation layer to prevent the modification reaction from progressing any further. After the modified surface layer is formed, the wet ALE process may expose the modified surface layer to a second solution to selectively dissolve the modified surface layer in a subsequent dissolution step. The dissolution step must selectively dissolve the modified surface layer without removing any of the underlying unmodified material. This selectivity can be accomplished by using a different solvent in the dissolution step than was used in the surface modification step, changing the pH, or changing the concentration of other components in the first solvent. The we ALE cycle can be repeated until a desired or specified etch amount is achieved.

Ruthenium (Ru) is a noble metal currently being considered as a replacement for copper in back end of line metallization, as well as front end of line features such as buried power rails (power rails positioned below active devices). Ruthenium's nobility, however, makes etching Ru difficult. Various etch processes may be used for etching ruthenium. For example, co-pending U.S. patent application Ser. No. 17/580,936, filed Jan. 21, 2022, entitled "Dynamically Adjusted Purge Timing in Wet Atomic Layer Etching" describes a wet ALE process for etching various transition metals, including ruthenium. In the co-pending application, a modified surface layer is formed by exposing surfaces of the Ru metal to an oxidizing agent. Although a ruthenium dioxide ($RuO_2$) surface layer is easy to form using a chemical solution containing dissolved oxygen or another oxidizing agent, the stability and insolubility of this surface oxide makes it difficult to deal with in the etch process. As such, strong oxidizers are typically used in conventional etch processes to create soluble or volatile ruthenium compounds.

Some commercially available ruthenium etchants do contain strong oxidizers, such as sodium hypochlorite, ceric ammonium nitrate and periodic acid, which oxidize ruthenium to create ruthenium tetroxide ($RuO_4$). Of these chemicals, the most effective etchants, ceric ammonium nitrate and sodium hypochlorite, are problematic because they pose a metal contamination hazard in the subsequently formed device. For example, incorporation of trace amounts of sodium or cerium in the front end of line can significantly degrade transistor performance. Periodic acid, on the other hand, is expensive and cannot be used to provide a cost-effective etch process for ruthenium. In addition, conventional etch processes often result in a rough post-etch ruthenium surface. This is because ruthenium grain boundaries tend to be much more reactive compared to the grain surface, which leads to preferential etching at the grain boundaries compared to the grain surfaces.

The combination of poor post-etch surface morphology, metal contamination risk, and chemical cost show the need for the development of better ruthenium etch chemistries.

SUMMARY

The present disclosure provides a new wet atomic layer etch (ALE) process for etching ruthenium. More specifically, the present disclosure provides various embodiments of methods that utilize new etch chemistries for etching ruthenium in a wet ALE process. Unlike conventional etch processes for ruthenium, the wet ALE process described herein for etching ruthenium is metal-free, cost-effective and improves surface roughness during etching.

New metal-free etchants are desired for etching of ruthenium to avoid risk of contamination of semiconductor devices. Surface morphology is also important for some etch applications, including etch-back for self-aligned vias. The polycrystalline nature of ruthenium makes it susceptible to pitting if an etchant preferentially attacks the grain boundaries. Etchant chemistry should, at a minimum, leave the surface no rougher than it was initially and ideally improve the surface roughness during etching. Acceptable surface morphology can be accomplished through the formation of a self-limiting passivation layer that is selectively removed in a cyclic wet ALE process.

In some embodiments, the present disclosure provides a cyclic wet ALE process that starts with the formation of an insoluble ruthenium halide or oxyhalide layer on the metal surface. For example, a ruthenium metal may be exposed to a halogenation agent in a self-limiting surface modification step to chemically modify an exposed surface of the ruthenium metal and form a modified surface layer. The modified surface layer may be a ruthenium halide, such as but not limited to, a ruthenium chloride, a ruthenium fluoride or a ruthenium bromide. The modified surface layer could also be a ruthenium oxyhalide, such as but not limited to, a ruthenium oxychloride or a ruthenium oxyfluoride. A dissolution step may then be performed to selectively remove the modified surface layer. For example, the modified surface layer may be exposed to a dissolution solution to selectively dissolve the modified surface layer without removing the ruthenium metal underlying the modified surface layer. The dissolution step is selective to the modified layer over the ruthenium metal and uses ligand-assisted dissolution to pull the ruthenium halide or ruthenium oxyhalide modified layer into solution.

Accordingly, a wet ALE process for etching ruthenium is disclosed herein that is metal-free, leaves the post-etch ruthenium surface smoother than the incoming surface, and can be accomplished using commodity chemicals. The etch chemistry described above differs from traditional wet ruthenium etch chemistries in that it primarily uses halogenation, rather than oxidation, as the basis to form a ruthenium species on the ruthenium surface that is soluble in the dissolution solution. Using the techniques described herein, an insoluble metal halide or oxyhalide passivation layer is formed during the surface modification step in contrast to the metal oxide layers typically formed when using conventional wet ALE chemistries.

In other embodiments, the present disclosure provides a cyclic wet ALE process that starts with the formation of a ruthenium salt passivation layer. For example, exposed surfaces of a ruthenium metal may be exposed to an oxidizing solution containing hydrochloric acid (HCl) to form an insoluble, self-limiting, ruthenium salt passivation layer over the ruthenium metal. The ruthenium species formed on the exposed surfaces of the ruthenium metal may be controlled by the concentration of the HCl, and the solubility of the subsequently formed ruthenium salt may be controlled by the HCl concentration and the cation species present in the oxidizing solution. The ruthenium salt passivation layer can then be removed in one of two ways: (a) by dissolving the ruthenium salt passivation layer in a different solvent, or (b) by using ion exchange to improve the solubility of the ruthenium salt passivation layer in the first solvent. Like the previously disclosed embodiment, the current embodiment provides a metal-free ruthenium etch process, using commodity chemicals, which reduces the surface roughness of ruthenium during etching. In addition, the wet ALE process described in the current embodiment may provide the further advantage of enabling isotropic or anisotropic etching by changing the oxidizer used in the surface modification step.

As noted above and described further herein, the present disclosure provides various embodiments of methods that utilize new etch chemistries for etching ruthenium in a wet ALE process. Of course, the order of discussion of the different steps as described herein has been presented for clarity sake. In general, these steps can be performed in any suitable order. Additionally, although each of the different features, techniques, configurations, etc. herein may be discussed in different places of this disclosure, it is intended that each of the concepts can be executed independently of each other or in combination with each other. Accordingly, the present invention can be embodied and viewed in many different ways.

According to one embodiment, a method of etching is provided herein for etching ruthenium. The method may generally include receiving a substrate having ruthenium formed thereon, wherein a ruthenium surface is exposed on a surface of the substrate, and exposing the surface of the substrate to a first etch solution such that the first etch solution is in contact with the ruthenium surface. The first etch solution may include one or more species that cause a passivation layer to be formed on the ruthenium surface, wherein the passivation layer is self-limited and insoluble to the first etch solution. Next, the method may include removing the first etch solution from the surface of the substrate subsequent to forming the passivation layer, and exposing the surface of the substrate to a second etch solution including a reactive agent and a solvent, wherein the reactive agent reacts with the passivation layer and forms soluble species that are dissolved by the solvent. Next, the method may include removing the second etch solution and the soluble species from the substrate.

In some embodiments, the method may further include repeating the steps of exposing the surface of the substrate to the first etch solution, removing the first etch solution, exposing the surface of the substrate to the second etch solution, and removing the second etch solution a number of cycles until a predetermined amount of the ruthenium is removed from the substrate.

A variety of different etch chemistries may be used in the first etch solution and the second etch solution. In some embodiments, the one or more species in the first etch solution may include a halogenation agent dissolved in a first solvent. For example, the halogenation agent may include a chlorination agent, a fluorinating agent or a brominating agent. The halogenation agent chemically modifies the ruthenium surface to form a halogenated ruthenium passivation layer. In some embodiments, the first etch solution may include a chlorination agent, such as trichloroisocyanuric acid (TCCA), oxalyl chloride, thionyl chloride or N-chlorosuccinimide, and the first solvent may include ethyl acetate (EA), acetone, acetonitrile, or a chlorocarbon. In some embodiments, the halogenated ruthenium passivation layer may include ruthenium trichloride ($RuCl_3$).

In some embodiments, the reactive agent in the second etch solution may be a ligand species, which reacts with and binds to the halogenated ruthenium passivation layer to form the soluble species that are dissolved by the solvent. In some embodiments, the ligand species may include ethylenediaminetetraacetic acid (EDTA), iminodiacetic acid (IDA), diethylenetriaminepentaacetic acid (DTPA) or acetylacetone (ACAC), and the solvent in the second etch solution may include a base.

In other embodiments, the one or more species in the first etch solution may include an oxidizer, a cation and a chlorine source reactive to the ruthenium. In such embodiments, the passivation layer formed on the ruthenium surface may include a ruthenate salt or a perruthenate salt. In one embodiment, the chlorine source may include hydrochloric acid (HCl). In such an embodiment, an oxidation amount of the passivation layer may be controlled by the concentration of the hydrochloric acid in the first etch solution.

According to another embodiment, a method of etching a substrate using a wet atomic layer etching (ALE) process is provided herein. The method may generally include: a) receiving the substrate, the substrate having a ruthenium (Ru) layer thereon; b) exposing the Ru layer to a first etch solution containing a halogenating agent to form a chemically modified Ru surface layer containing a ruthenium halide or a ruthenium oxyhalide; c) rinsing the substrate with a first purge solution to remove the first etch solution from a surface of the substrate; d) exposing the chemically modified Ru surface layer to a second etch solution to dissolve the chemically modified Ru surface layer; e) rinsing the substrate with a second purge solution to remove the second etch solution from the surface of the substrate; and f) repeating steps b)-e) for one or more cycles.

In some embodiments, the first etch solution used in step b) may include a chlorination agent dissolved in a first solvent. For example, the chlorination agent may include trichloroisocyanuric acid (TCCA), oxalyl chloride, thionyl chloride or N-chlorosuccinimide, and the first solvent may include ethyl acetate (EA), acetone, acetonitrile, or a chlorocarbon. In such embodiments, the chlorination agent may react with the Ru layer to form a ruthenium chloride.

In some embodiments, the second etch solution used in step d) may include a ligand dissolved in a second solvent. For example, the ligand may include ethylenediaminetetraacetic acid (EDTA), iminodiacetic acid (IDA), diethylenetriaminepentaacetic acid (DTPA) or acetylacetone (ACAC), and the second solvent may include a base. In such embodiments, the ligand may react with and bind to the chemically modified Ru surface layer to form a soluble species that dissolves within the second solvent.

According to yet another embodiment, another method of etching a substrate using a wet atomic layer etching (ALE) process is provided herein. The method may generally include: a) receiving the substrate, the substrate having a ruthenium (Ru) layer thereon; b) exposing the Ru layer to a first etch solution containing an oxidizer, a cation and a chlorine source reactive to the Ru layer to form a chemically modified Ru surface layer containing a ruthenium salt; c) rinsing the substrate with a first purge solution to remove the first etch solution from a surface of the substrate; d) exposing the chemically modified Ru surface layer to a second etch solution to dissolve the chemically modified Ru surface layer; e) rinsing the substrate with a second purge solution to remove the second etch solution from the surface of the substrate; and f) repeating steps b)-e) for one or more cycles.

In some embodiments, the chlorine source within the first etch solution may include hydrochloric acid (HCl). In some embodiments, the oxidizer within the first etch solution may include ammonium persulfate (APS) or tetrabutylammonium peroxymonosulfate (TBAPMS). In some embodiments, the cation within the first etch solution may include tetramethylammonium (TMA+), tetraalkyl ammonium, phosphonium, pyridinium, pyrrolidinium, or sulfonium ions. In some embodiments, the first etch solution may further include a salt, wherein the salt comprises tetramethyl ammonium chloride (TMAC) or 1-butyl-3-methylimidizolium chloride.

In some embodiments, the chemically modified Ru surface layer may be insoluble in the first etch solution and soluble in the second etch solution. In such embodiments, the second etch solution may include trichlorobenzene.

In some embodiments, the chemically modified Ru surface layer may be insoluble in the first etch solution, and the method may further include using ion exchange to improve the solubility of the chemically modified Ru surface layer. In such embodiments, the second etch solution may include potassium chloride (KCl) and potassium hydroxide (KOH).

Note that this summary section does not specify every embodiment and/or incrementally novel aspect of the present disclosure or claimed invention. Instead, this summary only provides a preliminary discussion of different embodiments and corresponding points of novelty over conventional techniques. For additional details and/or possible perspectives of the invention and embodiments, the reader is directed to the Detailed Description section and corresponding figures of the present disclosure as further discussed below.

BRIEF DESCRIPTION OF THE DRAWINGS

A more complete understanding of the present inventions and advantages thereof may be acquired by referring to the following description taken in conjunction with the accompanying drawings, in which like reference numbers indicate like features. It is to be noted, however, that the accompanying drawings illustrate only exemplary embodiments of the disclosed concepts and are therefore not to be considered limiting of the scope, for the disclosed concepts may admit to other equally effective embodiments.

DETAILED DESCRIPTION

Figure 1:
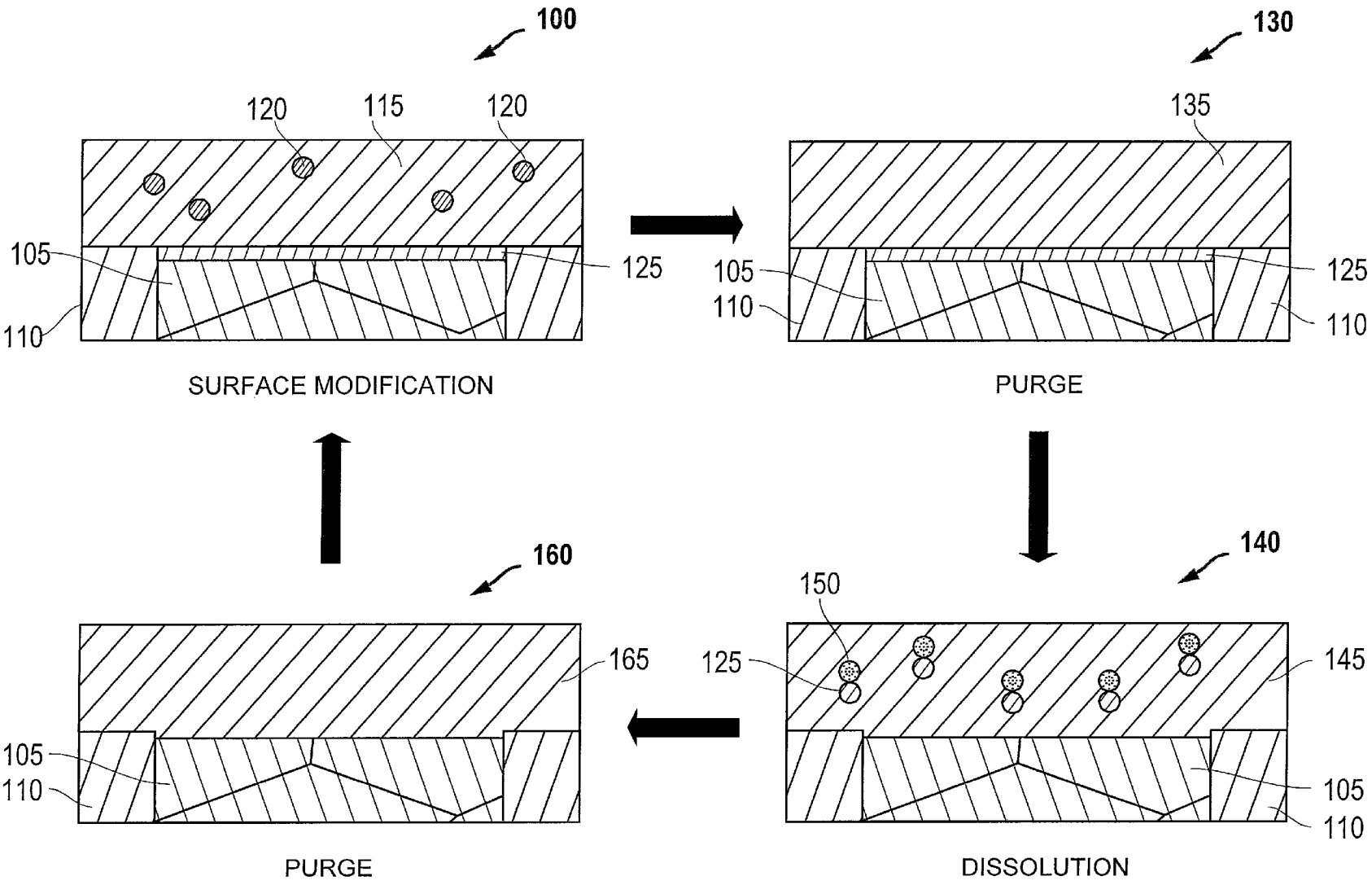
FIG. 1 illustrates one example of a cyclic wet atomic layer etching (ALE) process that can be used to etch ruthenium in accordance with the present disclosure.

The present disclosure provides a new wet atomic layer etch (ALE) process for etching ruthenium. More specifically, the present disclosure provides various embodiments of methods that utilize new etch chemistries for etching ruthenium in a wet ALE process. In some embodiments, the wet ALE process described herein may use halogenation, rather than oxidation, to form an insoluble ruthenium halide or oxyhalide passivation layer over the unmodified ruthenium metal in a surface modification step of the wet ALE process. The ruthenium halide or oxyhalide passivation layer may then be dissolved in a dissolution solution, which uses ligand-assisted dissolution to pull the ruthenium halide or oxyhalide passivation layer into solution. In other embodiments, the wet ALE process described herein may form an insoluble ruthenium salt passivation layer over the unmodified ruthenium metal by exposing the ruthenium metal to an oxidizing solution containing concentrated hydrochloric acid (HCl). The ruthenium salt passivation layer may then be removed by: (a) dissolving the ruthenium salt passivation layer in a different solvent, or (b) using ion exchange to improve the solubility of the ruthenium salt passivation layer in the first solvent.

The techniques described herein may be generally used to etch ruthenium, which is a polycrystalline noble metal. Although many chemicals can be used to etch ruthenium, the polycrystalline nature of ruthenium makes it susceptible to pitting if an etchant preferentially attacks the grain boundaries. Etchant chemistry should, at a minimum, leave the surface no rougher than it was initially and ideally improve the surface roughness during etching. Acceptable surface morphology can be accomplished through the formation of a self-limiting passivation layer that is selectively removed in a cyclic wet ALE process.

As noted above, conventional methods for etching ruthenium often use oxidizing agents (or oxidizers) to form a ruthenium metal-oxide passivation layer on the ruthenium surface. This ruthenium metal-oxide passivation layer may be an insoluble ruthenium dioxide ($RuO_2$) surface layer or a soluble ruthenium tetroxide ($RuO_4$) surface layer on exposed surfaces of the ruthenium. The oxidizers used in these methods either: (a) provide an insoluble modified surface layer (e.g., $RuO_2$), which is difficult to deal with in the etch process, or (b) are costly and/or pose a metal contamination risk.

The techniques described herein offer multiple advantages over other conventional methods used for etching ruthenium. For example, the wet ALE process described herein utilize etch chemistries that are metal-free, cost-effective and improve surface roughness during etching. In addition the advantages provided by the new etch chemistries disclosed herein, the techniques described herein provide the benefits of ALE (such as, e.g., precise control of total etch amount, control of surface roughness, and improvements in wafer-scale uniformity) and wet etching (such as, e.g., such as the simplicity of the etch chamber, atmospheric temperature and pressure etching conditions). As such, the techniques described herein provide a unique method for etching ruthenium.

In general, the wet ALE process described herein may be used to etch ruthenium by performing one or more cycles of the wet ALE cycle, where each cycle includes a surface modification step and a dissolution step. In the surface modification step, an exposed surface of the ruthenium may be exposed to a surface modification solution to chemically modify the exposed surface of the ruthenium and form a modified surface layer (e.g., a ruthenium halide, a ruthenium oxyhalide or a ruthenium salt passivation layer). In the dissolution step, the modified surface layer may be selectively removed by exposing the modified surface layer to a dissolution solution to dissolve the modified surface layer. Purge steps may be performed between the surface modification and dissolution steps to prevent the surface modification and dissolution solutions from mixing, and the process may be repeated in a cyclic manner until a desired amount of etching is achieved.

FIG. 1 illustrates one example of a wet ALE process in accordance with the present disclosure. More specifically, FIG. 1 illustrates exemplary steps performed during one cycle of a wet ALE process. In the process shown in FIG. 1, a polycrystalline material 105 surrounded by a dielectric material 110 is brought in contact with a surface modification solution 115 during a surface modification step 100 to modify exposed surfaces of the polycrystalline material 105. In one embodiment, the polycrystalline material 105 to be etched may be a noble metal, such as but not limited to, ruthenium (Ru). In some embodiments, the surface modification solution 115 can contain a halogenation agent 120. For example, the surface modification solution 115 may include a first solvent containing a chlorination agent, a fluorinating agent or a brominating agent. In other embodiments, the surface modification solution 115 may include an oxidizing agent and a chloride salt in concentrated hydrochloric acid (HCl).

As shown in FIG. 1, a chemical reaction occurs at the exposed surface of the polycrystalline material 105 to form a modified surface layer 125 (e.g., a ruthenium halide, a ruthenium oxyhalide or a ruthenium salt modified surface layer) in the surface modification step 100. In some cases, the chemical reaction to form the modified surface layer 125 may be fast and self-limiting. In other words, the reaction product may modify one or more monolayers of the exposed surface of the polycrystalline material 105, but may prevent any further reaction between the surface modification solution 115 and the underlying surface. By necessity, neither the polycrystalline material 105 to be etched nor the modified surface layer 125 can be soluble in the surface modification solution 115. In some cases, the surface modification step 100 shown in FIG. 1 may continue until the surface reaction is driven to saturation.

After the modified surface layer 125 is formed, the substrate may be rinsed with a first purge solution 135 to remove excess reactants from the surface of the substrate in a first purge step 130. The purge solution 135 should not react with the modified surface layer 125 or with the reagents present in the surface modification solution 115. In some embodiments, the first purge solution 135 used in the first purge step 130 may use the same solvent previously used in the surface modification step 100. In other embodiments, a different solvent may be used in the first purge solution 135. In some embodiments, the first purge step 130 may be long enough to completely remove all excess reactants from the substrate surface.

Once rinsed, a dissolution step 140 is performed to selectively remove the modified surface layer 125. In the dissolution step 140, the modified surface layer 125 is exposed to a dissolution solution 145 to selectively remove or dissolve the modified surface layer 125 without removing the unmodified polycrystalline material 105 underlying the modified surface layer 125. The modified surface layer 125 must be soluble in the dissolution solution 150, while the unmodified polycrystalline material 105 underlying the modified surface layer 125 must be insoluble. The solubility of the modified surface layer 125 allows its removal through dissolution into the bulk dissolution solution 150. In some embodiments, the dissolution step 140 may continue until the modified surface layer 125 is completely dissolved.

A variety of different dissolution solutions 145 may be used in the dissolution step, depending on the surface modification solution 115 used during the surface modification step 100 and/or the modified surface layer 125 formed. In some embodiments, for example, the dissolution solution 145 may be an aqueous solution containing a ligand 150, which assists in the dissolution process. For example, the ligand 150 may react or bind with the modified surface layer 125 to form a soluble species that dissolves within the dissolution solution 145. In other embodiments, the dissolution solution 145 may be a second solvent, which is different from the first solvent used in the surface modification solution 115. In other embodiments, the dissolution solution 145 may contain alkali metal ions in a basic solution. In such embodiments, ion exchange may be used to improve the solubility of the modified surface layer 125 in aqueous solution.

Once the modified surface layer 125 is dissolved, the ALE etch cycle shown in FIG. 1 may be completed by performing a second purge step 160. The second purge step 160 may be performed by rinsing the surface of the substrate with a second purge solution 165, which may be the same or different than the first purge solution 135. In some embodiments, second purge solution 165 may use the same solvent, which was used in the dissolution solution 145. The second purge step 160 may generally continue until the dissolution solution 145 and/or the reactants contained with the dissolution solution 145 are completely removed from the surface of the substrate.

As described above, the cyclic wet ALE process shown in FIG. 1 includes: a) a first surface modification step 100 to chemically modify exposed surfaces of a polycrystalline material 105 by exposing the exposed surfaces of the polycrystalline material 105 to surface modification solution 115 to form a modified surface layer 125; b) a first purge step 130 to rinse the substrate with a first purge solution 135 to remove excess reactants from the surface; c) a dissolution step 140 to selectively remove or dissolve the modified surface layer 125 by exposing the modified surface layer to a dissolution solution 145 to selectively remove the modified surface layer; and d) a second purge step 160 to rinse the substrate with a second purge solution 165 and displace the dissolution solution 145 from the surface of the substrate. In some embodiments, the steps a)-d) may be repeated for one or more ALE cycles, until a desired amount of the polycrystalline material 105 has been removed. It is recognized that the cyclic wet ALE process shown in FIG. 1 is merely one example of an etch process that may be used to etch a polycrystalline material 105, such as ruthenium.

Wet ALE of ruthenium requires the formation of a self-limiting passivation layer on the ruthenium surface. The formation of this passivation layer is accomplished by exposure of the ruthenium surface to a first etch solution (i.e., surface modification solution 115) that enables or causes a chemical reaction between the species in solution and the ruthenium surface. This passivation layer must be insoluble in the solution used for its formation, but freely soluble in the second etch solution (i.e., dissolution solution 145) used for its dissolution.

The present disclosure contemplates a wide variety of etch chemistries that may be used in the surface modification solution 115 and the dissolution solution 145 when etching ruthenium using the wet ALE process shown in FIG. 1. Example etch chemistries are discussed in more detail below. Mixing of these solutions leads to a continuous etch process, loss of control of the etch and roughening of the pos-etch surface, all of which undermines the benefits of wet ALE. Thus, purge steps 130 and 160 are performed in the wet ALE process shown in FIG. 1 to prevent direct contact between the surface modification solution 115 and the dissolution solution 145 on the substrate surface.

According to one embodiment, the ruthenium surface may be exposed to a surface modification solution 115 including a first solvent containing a chlorination agent, which chemically modifies the ruthenium surface to form a ruthenium chloride passivation layer. In one example embodiment, a ruthenium trichloride ($RuCl_3$) may be used as the passivation layer. For example, a $RuCl_3$ passivation layer may be formed when the ruthenium surface is exposed to a solution of trichloroisocyanuric acid (TCCA) dissolved in ethyl acetate (EA). In this embodiment, the TCCA may act as both the oxidizer and the chlorine source in the reaction. Although the TCCA oxidizes the ruthenium surface in the chemical sense to form a ruthenium trichloride ($RuCl_3$) passivation layer on the ruthenium surface, no metal-oxide is being formed in the reaction. This differs from conventional ruthenium etch chemistries, which utilize oxidizing agents (or oxidizers) to form a ruthenium metal-oxide passivation layer.

The chlorine chemistry of ruthenium is very complicated. There are two distinct crystalline phases of $RuCl_3$. $\alpha$-$RuCl_3$ is almost completely insoluble, while $\beta$-$RuCl_3$ is hygroscopic and freely soluble in water, alcohol, and many organic solvents. Additionally, mixed oxychlorides can be formed when oxygen or water are present during chlorination. These oxychlorides tend to be highly soluble. Based on this chemistry, the $\alpha$-phase of $RuCl_3$ is considered herein as a preferred passivation layer, in some embodiments. Phase formation, however, is controlled by the reaction conditions.

The self-limiting passivation layer formed during the surface modification step 100 must be removed every cycle after its formation. A second solution is used in the dissolution step 140 to selectively dissolve this modified layer. When TCCA dissolved in EA is used in the surface modification solution 115 to form $\alpha$-$RuCl_3$ on the ruthenium surface, a pure solvent does not work well in the dissolution step 140 because of the difficulty in dissolving $\alpha$-$RuCl_3$. Reactive dissolution, however, can be used to effectively remove the ruthenium chloride layer. In reactive dissolution, ligands dissolved in a second solvent react with the surface to form a soluble species that dissolves within the dissolution solution 145. Many different ligand species can be used for reactive dissolution of the $RuCl_3$ passivation layer. In one embodiment, ethylenediaminetetraacetic acid (EDTA) may be used as the ligand species for reactive dissolution. EDTA reacts with $RuCl_3$ to form a Ru-EDTA complex that is soluble in aqueous solution. This reaction is base catalyzed, so the dissolution solution must contain EDTA and a strong base. Mixing of the TCCA-containing surface modification solution 115 and the EDTA-containing dissolution solution 145 leads to a continuous etch process, loss of control of the etch, and roughening of the surface. Therefore, solvent rinse steps (i.e., purges steps 130 and 160) are necessary to prevent direct contact between the two etch solutions on the Ru metal surface.

In the etch chemistry described above, the reactant used for the chlorination of the ruthenium surface is TCCA; however, many chlorination agents will work for this step. Alternative chlorination agents include, but are not strictly limited to, oxalyl chloride, thionyl chloride and N-chlorosuccinimide. This is not an exhaustive list of all possible chlorination agents that may be used in the surface modification step 100. Additionally, other ruthenium halides can also be used as a passivation layer. For example, ruthenium fluoride and ruthenium bromide can each be used, in addition to $RuCl_3$. These ruthenium halides can be formed using fluorinating or brominating agents, such as but not limited to, 1-Fluoro-2,4,6-trimethylpyridinium tetrafluoroborate, N-fluorobenzenesulfonimide, N-bromosuccinimide, or dibromoisocyanuric acid.

In the etch chemistry described above, the first solvent used for the chlorination reaction is EA; however, other solvents such as acetone, acetonitrile, and chlorocarbons can also be used. Again, this is not an exhaustive list of solvents that can be used in the surface modification step 100.

In the etch chemistry described above, the dissolution solution 145 is an aqueous solution of EDTA as the ligand 150 and tetramethylammonium hydroxide ($(CH_3)_4NOH$) as the base. Alternative ligands for dissolution include, but are not limited to, iminodiacetic acid (IDA), diethylenetriaminepentaacetic acid (DTPA), and acetylacetone (ACAC). EDTA, IDA, and DTPA can be used in aqueous solution, while ACAC can be used in aqueous solution, ethanol, dimethyl sulfoxide (DMSO) or other organic solvents. Any strong base can be used in the dissolution solution 145. For example, bases such as potassium hydroxide (KOH), sodium hydroxide (NaOH), ammonium hydroxide ($NH_4OH$), Tetramethylammonium hydroxide ($(CH_3)_4NOH$), or any other strong base can be used in the dissolution solution 145 as it is just needed to deprotonate the ligand 150 to allow binding with the ruthenium surface.

Etching experiments were conducted on coupons cut from a 300 mm silicon wafer with various thicknesses of chemical vapor deposition (CVD) ruthenium deposited on one side. The etch recipe used to etch the ruthenium includes multiple wet ALE cycles, where each cycle includes a one minute dip in 5% TCCA dissolved in EA, followed by an EA rinse, a 30 second dip in an aqueous solution of 50 mM EDTA and 1 M KOH in $H_2O$ (or deionized water), a 1 M KOH rinse (or deionized water rinse) and an isopropyl alcohol (IPA) rinse and blow dry. The wet ALE process is repeated for a number of ALE cycles under different process conditions: a hot water dissolution, a room temperature (RT) reactive dissolution and a hot reactive dissolution. The hot dissolutions were performed at 100° C.

Figure 2:
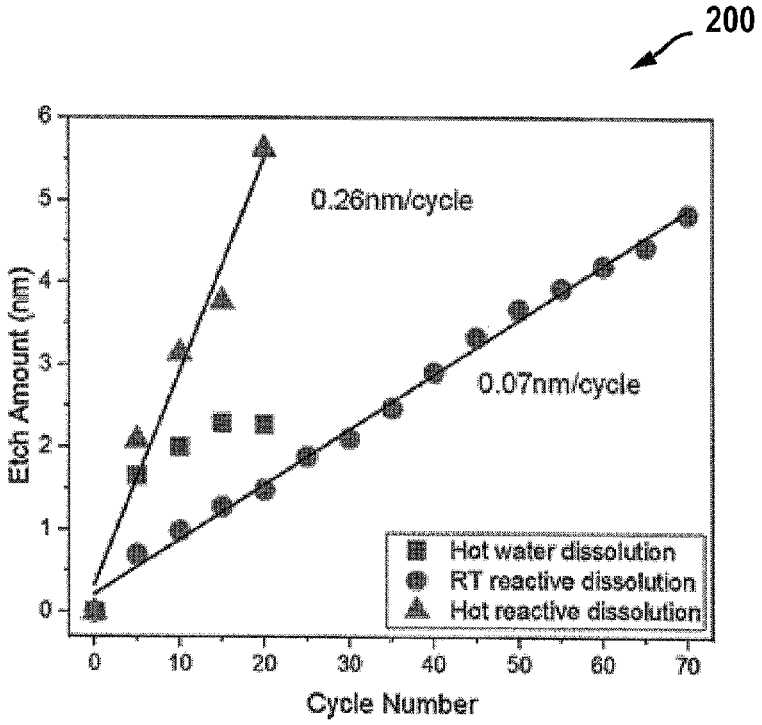
FIG. 2 is a graph depicting exemplary etch amounts (expressed in nanometers, nm) that may be achieved as a function of cycle number when attempting to etch a ruthenium (Ru) using various etch conditions.

The total etch amount (nm) as a function of cycle number for the various etch conditions described above is illustrated in the graph 200 shown in FIG. 2. Reactive dissolution at room temperature (RT) gives an etch rate of 0.07 nm/cycle. This is much less than a full monolayer of ruthenium and indicates that the dissolution kinetics may be slow at room temperature. The etch amount per cycle increases substantially (e.g., 0.26 nm/cycle) when the dissolution solution is heated, confirming that the dissolution is kinetically limited. The etch rate decreased with cycle number and eventually stopped when the experiment was run using deionized water for dissolution, rather than a solution of EDTA and KOH. This behavior can be explained if the passivation layer contains a mixture of $\alpha$-$RuCl_3$, $\beta$-$RuCl_3$, and various ruthenium oxychlorides ($RuO_xCl_y$). The $\beta$-$RuCl_3$ and $RuO_xCl_y$ will be water-soluble while the $\alpha$-$RuCl_3$ will remain on the surface. The amount of $\alpha$-$RuCl_3$ on the surface will increase, cycle after cycle, until the entire surface is passivated with insoluble $\alpha$-$RuCl_3$ and the etch cannot continue. This behavior indicates that ligands 150 in the dissolution solution 145 are beneficial to successful etch behavior.

Figure 3A:
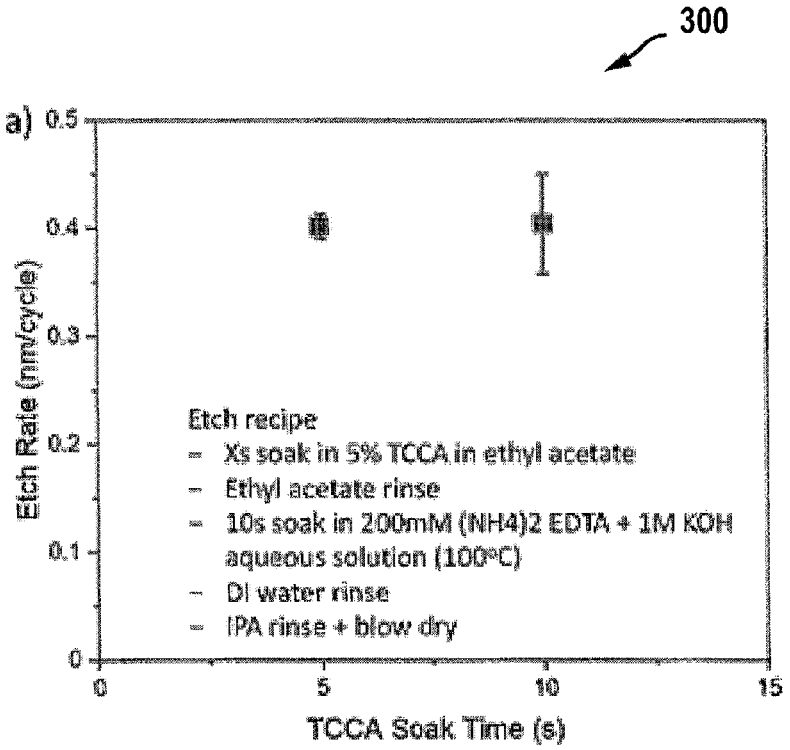
FIG. 3A is a graph illustrating exemplary etch rates (expressed in nm/cycle) that may be achieved as a function of surface modification solution soak time (expressed in seconds).
Figure 3B:
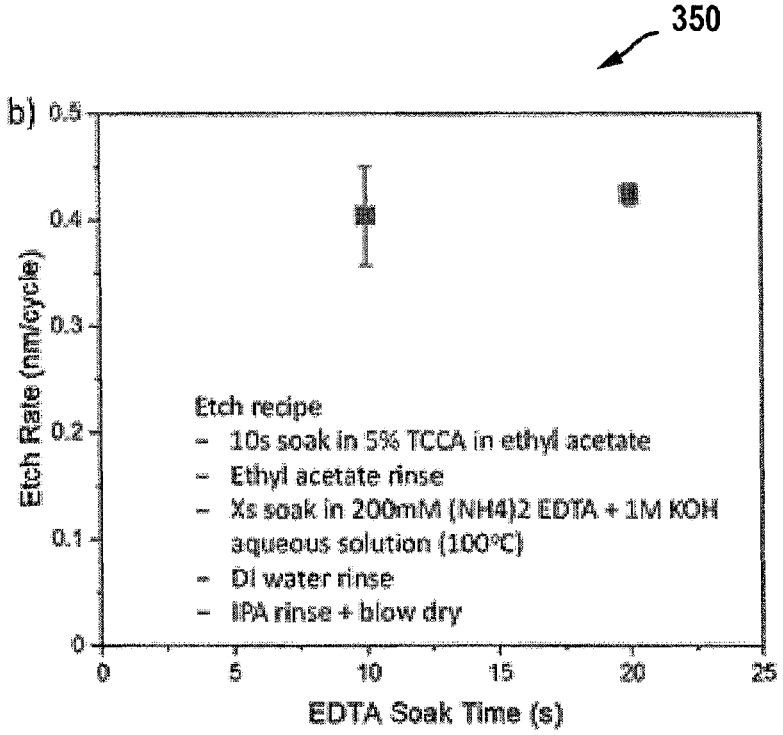
FIG. 3B is a graph illustrating exemplary etch rates (expressed in nm/cycle) that may be achieved as a function of dissolution solution soak time (expressed in seconds).

The wet ALE process described above relies on both the surface modification and dissolution reactions being self-limiting. Self-limiting means that only a limited thickness of the ruthenium at the surface is modified or removed, regardless of how long a given etch solution is in contact with the ruthenium surface. The self-limiting reaction can be limited to one or more monolayers of reaction, or a partial monolayer of reaction. The self-limiting behavior of the ruthenium etch chemistry and etch recipe described above is illustrated in the graphs 300 and 350 shown in FIGS. 3A and 3B. In FIG. 3A, a coupon having CVD ruthenium is etched by soaking the coupon in 5% TCCA dissolved in EA for X seconds, rinsing the coupon in EA, soaking the coupon in 200 mM $(NH_4)_2$ EDTA and 1M KOH aqueous solution at 100° C. for 10 seconds, rinsing the coupon in deionized water, followed by an IPA rinse and blow dry. In FIG. 3B, the etch recipe is changed by soaking the coupon in 5% TCCA dissolved in EA for 10 seconds and soaking the coupon in 200 mM $(NH_4)_2$ EDTA and 1M KOH aqueous solution at 100° C. for X seconds.

The graph 300 in FIG. 3A shows that the chlorination reaction is self-limiting—the etch amount per cycle does not change when the TCCA soak time is doubled from 5 seconds to 10 seconds. The graph 350 in FIG. 3B shows that the dissolution reaction is also self-limiting. The etch amount per cycle does not change when the dissolution time is doubled from 10 seconds to 20 seconds. The etch amount per cycle is higher in FIGS. 3A and 3B than shown in FIG. 2, but this is due to different experimental conditions. For example, the ligand concentration used in the dissolution solution in FIGS. 3A and 3B is higher, and the diammonium salt of EDTA is used instead of EDTA. In these experiments, approximately two monolayers of ruthenium are removed each etch cycle.

Figure 4:
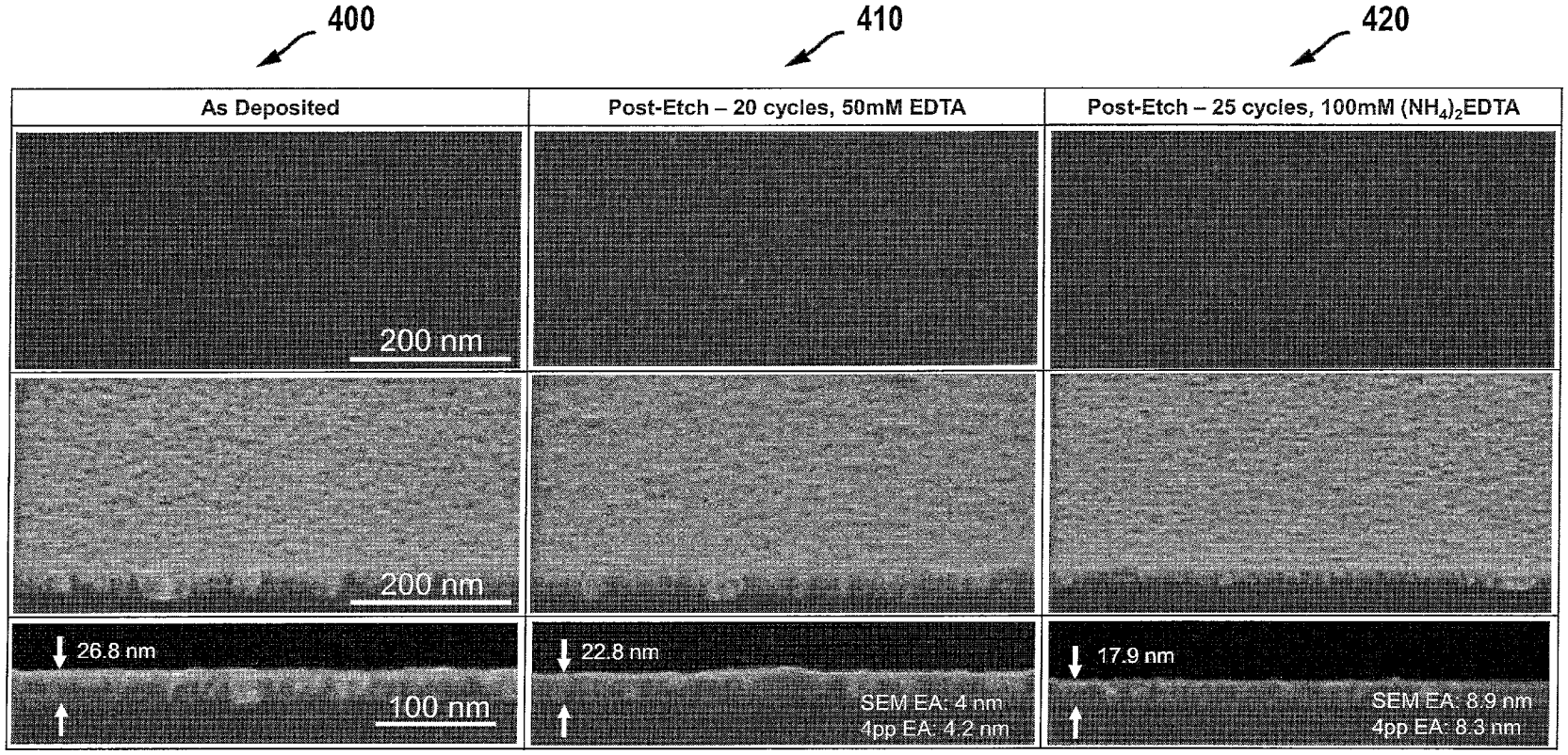
FIG. 4 show scanning electron microscope (SEM) images of as-deposited ruthenium and post-etch ruthenium for various etch conditions.

The wet ALE process described above causes smoothing of the etched surface. To observe the etched surface, scanning electron microscope (SEM) images of as-deposited ruthenium (400) and post-etch ruthenium (410, 420) were obtained for various etch conditions. The SEM images illustrated in FIG. 4 show that the ruthenium metal surface is smoothed during the etch process. There are two sets of post-etch SEM images illustrated in FIG. 4. In the first set of post-etch SEM images 410, a coupon is etched using 50 mM EDTA in the dissolution solution. Using this etch solution resulted in approximately 4 nm of etching after 20 cycles. The second set of post-etch SEM images 420 shows a coupon etched using 100 mM diammonium EDTA in the dissolution solution. This coupon was etched almost 9 nm after 25 cycles. In both cases, the etch amount calculated from 4-point probe resistivity measurements of the ruthenium film and the etch amount measured by SEM cross section are in good agreement. The top down and tilt view of the post-etch SEM images 410 and 420 show that the roughness of the ruthenium surface appears to have decreased during the etch process.

The ruthenium wet ALE process described above and shown in FIGS. 1-4 can be accomplished using a variety of techniques. For example, the ruthenium wet ALE process disclosed above may be performed by dipping the ruthenium sample in beakers of each etch solution. In this case, purging can be accomplished by either rinsing or dipping the sample in an appropriate solvent bath. The ruthenium wet ALE process can also be accomplished on a spinner. For example, the ruthenium sample may be rotated while the etchant solutions are dispensed from a nozzle positioned above the sample. The rotational motion of the sample distributes the solution over the surface. After the set exposure time, the nozzle begins dispensing the next solution in the etch recipe. This process continues through the whole etch cycle and repeats for as many cycles as necessary to remove the desired amount of metal. For high volume manufacturing, dispensing of etch solutions and rinses can be executed using conventional tools, such as wet etching tools and rinse tools.

While ruthenium chloride ($RuCl_3$) and other ruthenium halides and oxyhalides provide a well-behaved, self-limiting modified surface layer for ruthenium wet ALE, they are not the only option available for creating a self-limiting passivation layer on the ruthenium surface. An alternative chemistry for ruthenium wet ALE may be used to form a self-limiting modified surface layer (or passivation layer) composed of a ruthenate salt or a perruthenate salt. In some embodiments, a ruthenate salt or a perruthenate salt may be formed during the surface modification step 100 by exposing the ruthenium surface to an oxidizing solution containing an oxidizer, an appropriate cation and a chlorine source, which is reactive to ruthenium, such as concentrated hydrochloric acid (HCl). The oxidation of ruthenium in an HCl solution leads to the formation of a ruthenium salt passivation layer containing $RuO_xCl_y^{z-}$ polyanions. The HCl acts as a mild reducing agent and limits the final oxidation state of the ruthenium. Thus, the ruthenium species formed on the surface can be controlled by the concentration of HCl in the oxidizing solution. Additionally, the solubility of the ruthenium salt can be controlled by the counter-ion coordinating with the ruthenium polyanion in the salt. Thus, the solubility of the ruthenium salt passivation layer can be controlled by the HCl concentration, as well as the cations present in the oxidizing solution.

After the insoluble ruthenium salt passivation layer is formed on the ruthenium surface, it can be removed in one of two ways—e.g., via solvent exchange or ion exchange—in a subsequently performed dissolution step 140. For example, the insoluble salt can be dissolved in a pure solvent in a dissolution step that utilizes solvent exchange, or the insoluble salt can be removed through a salt metathesis reaction where the cation is exchanged to improve the solubility of the ruthenium salt in aqueous solution (e.g., ion exchange method). A diagram of this salt-mediated wet ALE process is shown in FIG. 5.

Figure 5:
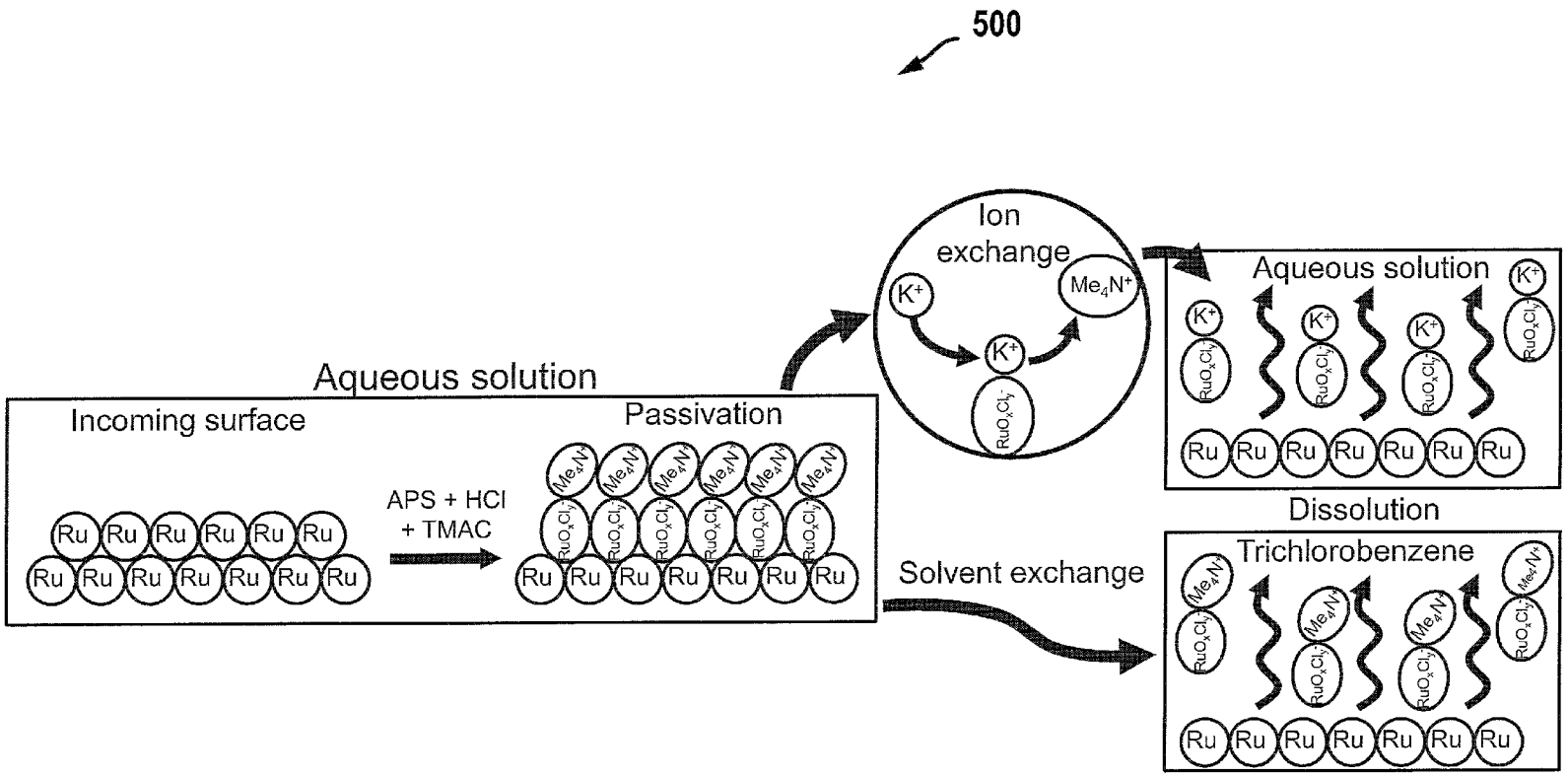
FIG. 5 illustrates one example of a salt-mediated wet ALE process that can be used to etch ruthenium in accordance with the present disclosure.

In the example salt-mediated wet ALE process 500 shown in FIG. 5, the ruthenium surface is exposed to an aqueous solution containing ammonium persulfate (APS) or tetrabutylammonium peroxymonosulfate (TBAPMS) as an oxidizer in concentrated HCl solution. Additionally, a salt such as tetramethyl ammonium chloride (TMAC) or 1-butyl-3-methylimidizolium chloride is present in aqueous solution to provide the cations needed for the ruthenium salt formation. The stability of the ruthenium salt passivation layer is generally dependent on the HCl concentration and the cation species. In one example experiment, a stable passivation layer was formed with an HCl concentration of 6M, and using TMAC as the salt species.

After the insoluble ruthenium salt passivation layer is formed on the ruthenium surface, it can be removed via solvent exchange or ion exchange. In the solvent exchange dissolution method, the insoluble ruthenium salt passivation layer can be dissolved in a pure solvent. In the example process 500 shown in FIG. 5, the insoluble salt is dissolved in trichlorobenzene. Other solvents may also be used. In the ion exchange dissolution method, the insoluble ruthenium salt passivation layer can be removed by using ion exchange to improve the solubility of the ruthenium salt passivation layer in the aqueous solution used to form the ruthenium salt passivation layer. In the example process 500 shown in FIG. 5, for example, the ruthenium salt passivation layer can be removed from the ruthenium surface by exchanging the $Me_4N+$ cations with K+ cations. This ion exchange improves the solubility of the ruthenium salt passivation layer, so that it can be dissolved within the aqueous solution.

FIGS. 6A-6D show quartz crystal microbalance (QCM) data obtained from ruthenium wet ALE experiments where a ruthenium surface is oxidized using an aqueous solution of APS, HCl and a chloride salt (e.g., tetrabutylammonium chloride, TBAC) to form a ruthenium salt passivation layer, which is subsequently dissolved in an aqueous solution of KOH and KCl. The graphs shown in FIGS. 6A-6D illustrate ruthenium etch behavior for a variety of oxidizer concentrations, HCl concentrations and cation species during the etch process.

Figure 6A:
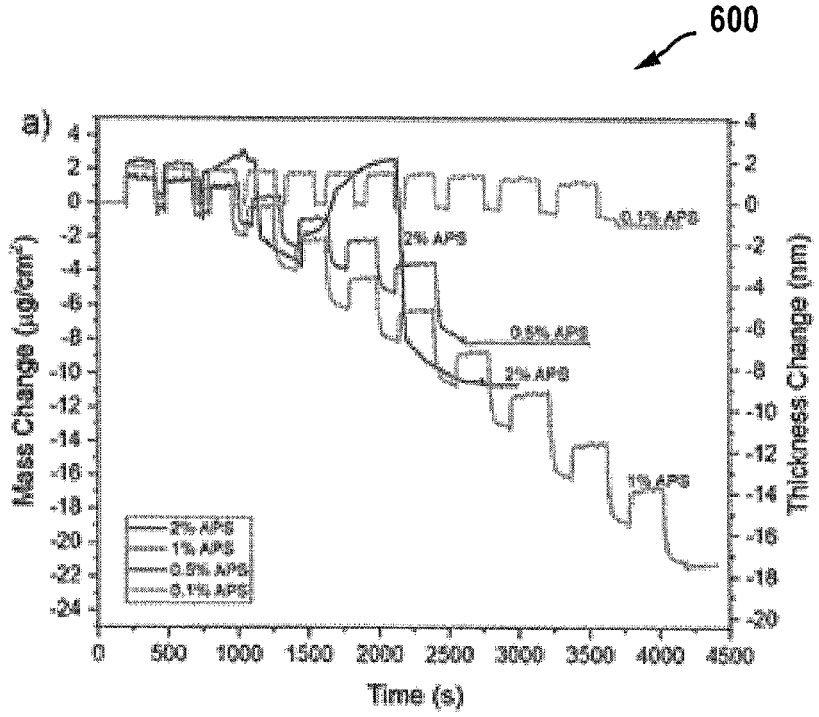
FIG. 6A is a graph of quartz crystal microbalance (QCM) data obtained from a salt-mediated wet ALE process experiment, where the data illustrates ruthenium etch behavior for a variety of oxidizer concentrations.

The graph 600 illustrated in FIG. 6A shows etch behavior at a variety of APS concentrations (e.g., 0.1% APS, 0.5% APS, 1% APS and 2% APS). The etch cycle includes 1 minute per step with oxidation in an aqueous solution containing APS, 6M HCl and 200 mM TBAC followed by a purge with 6M HCl plus 200 mM TBAC, dissolution in 1M KCl plus 100 mM KOH, and a second purge with the 6M HCl plus 200 mM TBAC solution. As shown in the graph 600, etching is relatively slow at 0.1% APS, and ceases to be self-limiting at 2% APS, but shows reasonably self-limiting etch behavior for intermediate APS concentrations.

Figure 6B:
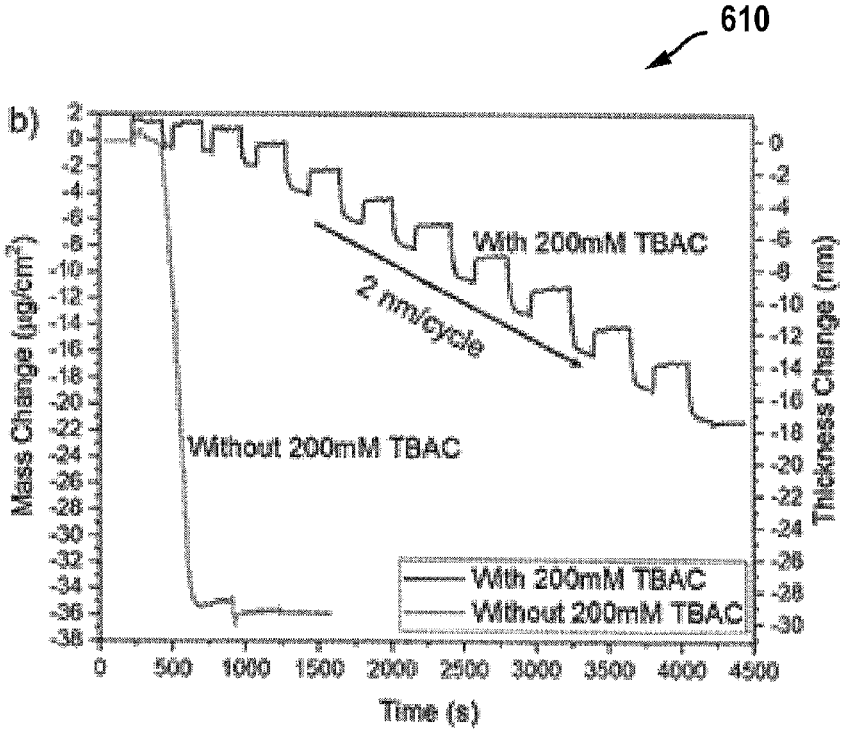
FIG. 6B is a graph of QCM data obtained from a salt-mediated wet ALE process experiment, where the data illustrates ruthenium etch behavior with and without a chloride salt (e.g., TBAC).

The graph 610 illustrated in FIG. 6B shows the effect of including and removing TBAC from the etch solutions. As shown in graph 610, oxidation is not self-limiting without the tetrabutylammonium cation (TBA+). This is likely due to the higher solubility of the acid species compared to the ammonium salt.

Figure 6C:
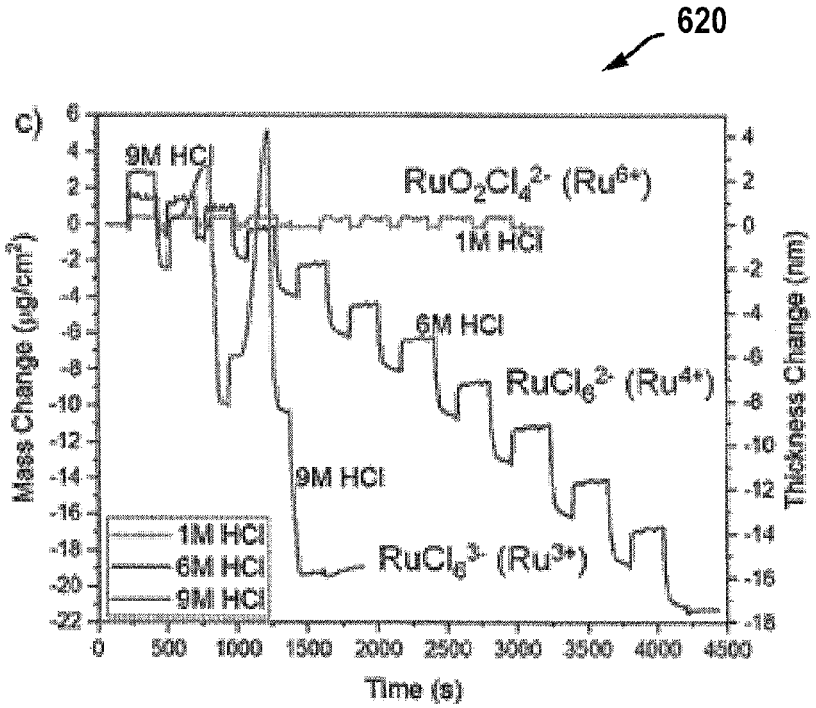
FIG. 6C is a graph of QCM data obtained from a salt-mediated wet ALE process experiment, where the data illustrates ruthenium etch behavior for a variety of HCl concentrations.

The graph 620 illustrated in FIG. 6C shows the etch behavior at a variety of HCl concentration (e.g., 1M, 6M and 9M HCl). As shown in graph 620, 1M HCl does not lead to etching, 6M HCl leads to a well-behaved cyclic etch, and 9M HCl leads to continuous oxidation. Literature on the chlorination chemistry of ruthenium indicates that $RuO_4$ is reduced to $RuO_2Cl_4^{2-}$ in 1M HCl, $RuCl_6^{2-}$ in 6M HCl, and $RuCl_6^{3-}$ in 9M HCl. The difference in etch behavior with HCl concentration is likely due to the different solubility properties of these ruthenium polyanions.

Figure 6D:
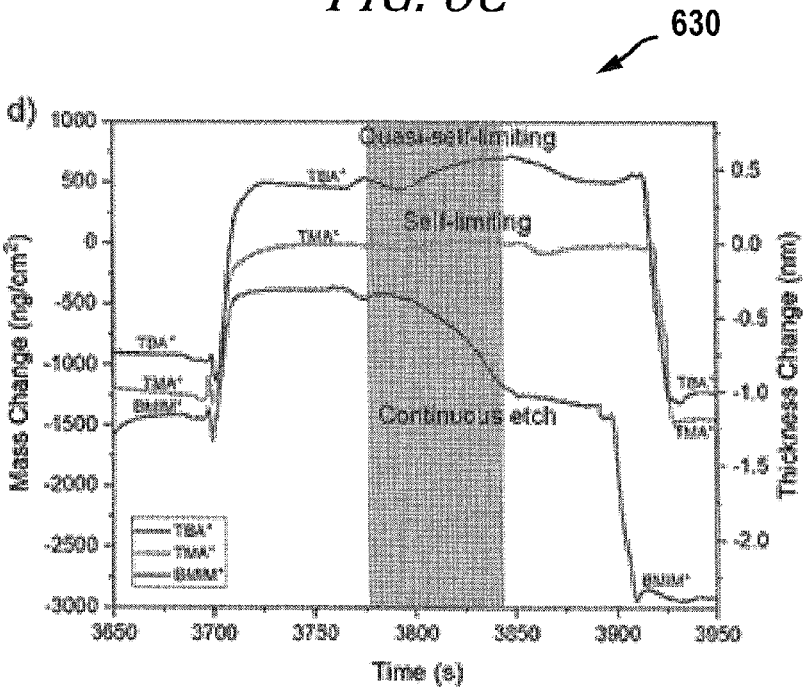
FIG. 6D is a graph of QCM data obtained from a salt-mediated wet ALE process experiment, where the data illustrates the effect of cation species on ruthenium etch behavior.

The graph 630 illustrated in FIG. 6D shows the effect of cation species on etch behavior when different cation species are used in the aqueous solution to form a ruthenium salt passivation layer. As shown in graph 630, oxidation is only quasi-self-limiting when TBA+ is used in the aqueous solution; however, the oxidation becomes completely self-limiting when tetramethylammonium (TMA+) is used. Oxidation leads to a continuous etch when 1-butyl ethylimidizolium (BMIM+) is used in the aqueous solution. The differences in the solubility of the ruthenium salts formed with these three cations may explain the differences in observed etch behavior. Although TMA+ was found to be self-limiting, TMA+ is not the only possible organic cation that can be used in this process. Other cations, such as other tetraalkyl ammonium, phosphonium, pyridinium, pyrrolidinium, or sulfonium ions can also be used.

Figure 7:
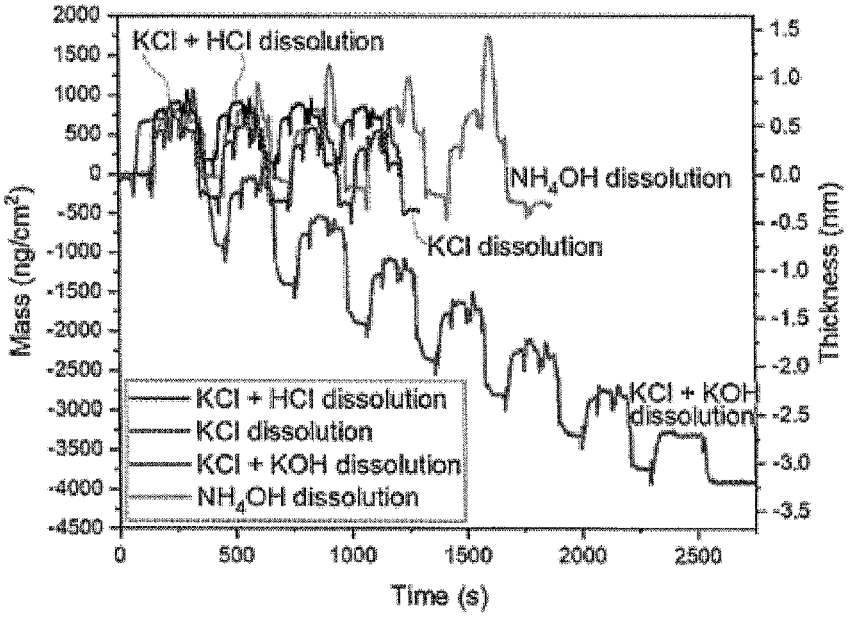
FIG. 7 is a graph of QCM data obtained from a salt-mediated wet ALE process experiment, where the data illustrates the ruthenium etch behavior using different dissolution solution compositions.

Dissolution of the ruthenium salt formed by APS oxidation in an aqueous solution (containing, for example, 6M HCl and 200 mM TMAC) requires K+ ion exchange in a basic solution. Exploration of the etch behavior using different dissolution solution compositions (e.g., KCl and HCl dissolution, KCl dissolution, KCl and KOH dissolution and $NH_4OH$ dissolution) is shown in FIG. 7. As illustrated in the graph 700 shown in FIG. 7, a solution containing KCl and HCl contains K+ ions, but is low pH, and thus, does not etch. A KCl solution contains K+ ions, but is at neutral pH, and also does not etch. An ammonium hydroxide ($NH_4OH$) solution is at high pH, but does not contain K+ ions, and thus, does not etch. As shown in the graph 700, the only dissolution solution that resulted in etching contained both KCl and KOH. This solution contained K+ ions at high pH, indicating that both of these properties are needed to solubilize the ruthenium salts formed during the oxidation step. In addition to K+ ions, other alkali metal ions such as Li+, Na+, or Rb+ may also be used in the dissolution solution.

The etch chemistry discussed above results in an anisotropic etch due to sulfate ion adsorbing on C-plane of ruthenium crystal lattice. Sulfate strongly adsorbs on this crystal facet, but does not adsorb on ruthenium m-planes. The adsorbed sulfate ions block further etching along the C-axis. TBAPMS, sold under the trade name OXONE, is an oxidizer that contains a high concentration of sulfate. APS is another oxidizer that forms sulfate as the reaction product. Both of these oxidizers lead to anisotropic etching of the ruthenium surface. In some embodiments, the APS or TBAPMS used in this etch chemistry can be replaced with a sulfate-free oxidizer, which should lead to isotropic etching of the ruthenium surface. However, the oxidizer must be compatible with concentrated HCl.

The data for the ruthenium etch chemistry described above and shown in FIGS. 5, 6A-6D and 7 was collected using a QCM flow cell. However, the etch chemistry can be implemented using several different techniques, such as dispensing the etch solutions on a spinner or sequentially dipping the samples to be etched in the etch solutions. The only important consideration in implementing this etch chemistry is temporal separation of chemical exposures: i.e., the oxidizing solution and the dissolution solution must be kept separate and prevented from mixing on the wafer surface. Any mixing of these two solutions can lead to a continuous etch process and an increase in surface roughness.

New etch chemistries are described above for etching ruthenium in a wet ALE process. As noted above, the ruthenium etch chemistries disclosed herein either: (a) primarily use halogenation to form an insoluble ruthenium halide or oxyhalide passivation layer, which is selectively removed via ligand-assisted dissolution, or (b) use oxidation in a concentrated HCl solution containing a chloride salt to form an insoluble ruthenium salt passivation layer, which is selectively removed by solvent or ion exchange. Unlike conventional etch chemistries, the etch chemistries described herein for etching ruthenium, are metal-free, cost-effective and improve surface roughness during etching.

The ruthenium wet ALE process described herein may be performed within a variety of semiconductor processing systems. While the ruthenium wet ALE process described herein can be accomplished using many different process chambers, tools and apparatuses, the processing equipment used to perform the ruthenium wet ALE process is preferably capable of running at (or near) room temperature and at (or near) atmospheric pressure. In one example implementation, the ruthenium wet ALE process described herein may be performed within a spin chamber. When a spin chamber is utilized, etch solutions are dispensed from a nozzle positioned over the substrate and are distributed by the rotational motion of a spin chuck on which the substrate is disposed.

Figure 8:
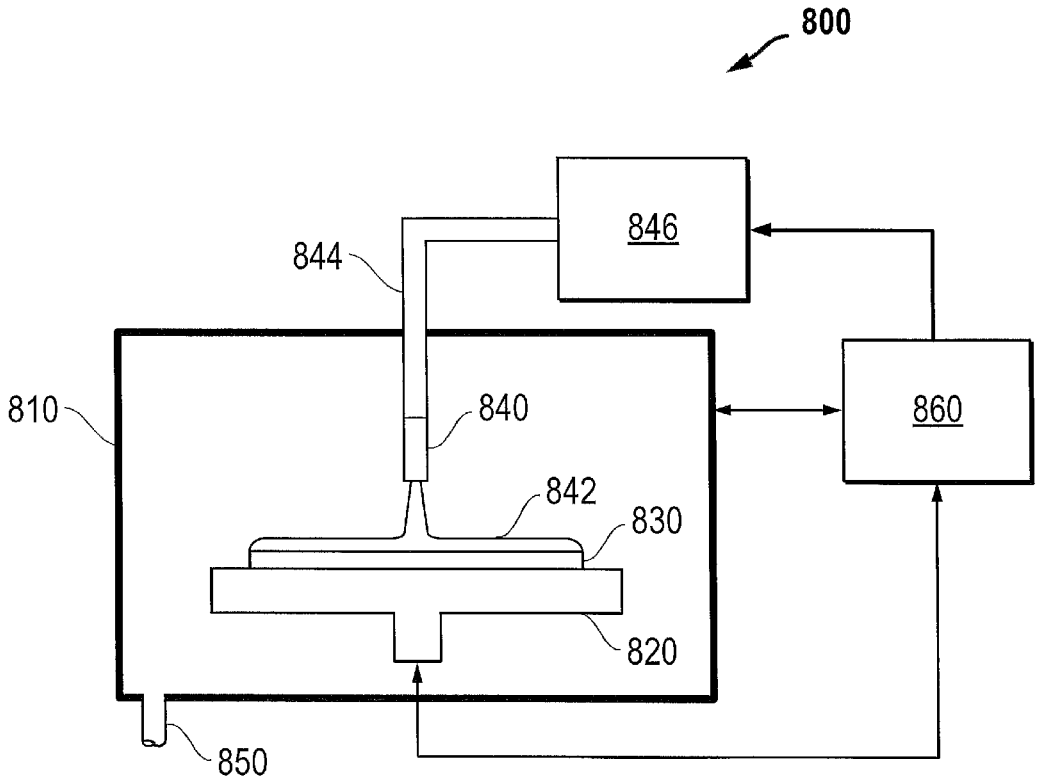
FIG. 8 is a block diagram of an example processing system that can use the techniques described herein to etch a polycrystalline material, such as ruthenium.

FIG. 8 illustrates one embodiment of a processing system 800 that may use the techniques described herein to etch a polycrystalline material, such as ruthenium, on a surface of a substrate 830. As shown in FIG. 8, the processing system 800 includes a process chamber 810, which in some embodiments, may be a pressure controlled chamber. In the embodiment shown in FIG. 8, the process chamber 810 is a spin chamber having a spinner 820 (or spin chuck), which is configured to spin or rotate at a rotational speed. A substrate 830 is held on the spinner 820, for example, via electrostatic force or vacuum pressure. In one example, the substrate 830 may be a semiconductor wafer having a polycrystalline material, such as ruthenium, formed on or within the substrate 830.

The processing system 800 shown in FIG. 8 further includes a liquid nozzle 840, which is positioned over the substrate 830 for dispensing various etch solutions 842 onto a surface of the substrate 830. The etch solutions 842 dispensed onto the surface of the substrate 830 may generally include a surface modification solution to chemically modify the ruthenium surface and form a modified surface layer (e.g., a ruthenium halide, a ruthenium oxyhalide or a ruthenium salt passivation layer), and a dissolution solution to selectively remove the modified surface layer from the ruthenium surface. Purge solutions may also be dispensed onto the surface of the substrate 830 between surface modification and dissolution steps to separate the surface modification and dissolution solutions. Examples of surface modification, dissolution and purge solutions are discussed above.

As shown in FIG. 8, the etch solutions 842 may be stored within a chemical supply system 846, which may include one or more reservoirs for holding the various etch solutions 842 and a chemical injection manifold, which is fluidly coupled to the process chamber 810 via a liquid supply line 844. In operation, the chemical supply system 846 may selectively apply desired chemicals to the process chamber 810 via the liquid supply line 844 and the liquid nozzle 840 positioned within the process chamber 810. Thus, the chemical supply system 846 can be used to dispense the etch solutions 842 onto the surface of the substrate 830. The process chamber 810 may further include a drain 850 for removing the etch solutions 842 from the process chamber 810.

Components of the processing system 800 can be coupled to, and controlled by, a controller 860, which in turn, can be coupled to a corresponding memory storage unit and user interface (not shown). Various processing operations can be executed via the user interface, and various processing recipes and operations can be stored in the memory storage unit. Accordingly, a given substrate 830 can be processed within the process chamber 810 in accordance with a particular recipe. In some embodiments, a given substrate 830 can be processed within the process chamber 810 in accordance with an etch recipe that utilizes the wet ALE techniques described herein for etching ruthenium.

The controller 860 shown in block diagram form in FIG. 8 can be implemented in a wide variety of manners. In one example, the controller 860 may be a computer. In another example, the controller 860 may include one or more programmable integrated circuits that are programmed to provide the functionality described herein. For example, one or more processors (e.g., microprocessor, microcontroller, central processing unit, etc.), programmable logic devices (e.g., complex programmable logic device (CPLD), field programmable gate array (FPGA), etc.), and/or other programmable integrated circuits can be programmed with software or other programming instructions to implement the functionality of a prescribed plasma process recipe. It is further noted that the software or other programming instructions can be stored in one or more non-transitory computer-readable mediums (e.g., memory storage devices, flash memory, dynamic random access memory (DRAM), reprogrammable storage devices, hard drives, floppy disks, DVDs, CD-ROMs, etc.), and the software or other programming instructions when executed by the programmable integrated circuits cause the programmable integrated circuits to perform the processes, functions, and/or capabilities described herein. Other variations could also be implemented.

As shown in FIG. 8, the controller 860 may be coupled to various components of the processing system 800 to receive inputs from, and provide outputs to, the components. For example, the controller 860 may be coupled to: the process chamber 810 for controlling the temperature and/or pressure within the process chamber 810; the spinner 820 for controlling the rotational speed of the spinner 820; and the chemical supply system 846 for controlling the various etch solutions 842 dispensed onto the substrate 830. The controller 860 may control other processing system components not shown in FIG. 8, as is known in the art.

In some embodiments, the controller 860 may control the various components of the processing system 800 in accordance with an etch recipe that utilizes the wet ALE techniques described herein for etching ruthenium. For example, the controller 860 may supply various control signals to the chemical supply system 846, which cause the chemical supply system 846 to: a) dispense a surface modification solution onto the surface of the substrate 830 to chemically modify exposed surfaces of the ruthenium and create a modified surface layer (e.g., a ruthenium halide, a ruthenium oxyhalide or a ruthenium salt passivation layer) on the substrate 830; b) rinse the substrate 830 with a first purge solution to remove excess reactants from the surface; c) dispense a dissolution solution onto the surface of the substrate 830 to selectively remove or dissolve the modified surface layer; and d) rinse the substrate with a second purge solution to remove the dissolution solution from the surface of the substrate 830. In some embodiments, the controller 860 may supply the control signals to the chemical supply system 846 in a cyclic manner, such that the steps a)-d) are repeated for one or more ALE cycles, until a desired amount of the ruthenium has been removed.

The controller 860 may also supply control signals to other processing system components. In some embodiments, for example, the controller 860 may supply control signals to the spinner 820 and/or the chemical supply system 846 to dry the substrate 830 after the second purge step is performed. In one example, the controller 860 may control the rotational speed of the spinner 820, so as to dry the substrate 830 in a spin dry step. In another example, control signals supplied from the controller 860 to the chemical supply system 846 may cause a drying agent (such as, e.g., isopropyl alcohol) to be dispensed onto the surface of the substrate 830 to further assist in drying the substrate before performing the spin dry step.

In some embodiments, the controller 860 may control the temperature and/or the pressure within the process chamber 810. In some embodiments, the surface modification, dissolution and purge steps of the ruthenium wet ALE process described herein may be performed at roughly the same temperature and pressure. In one example implementation, the surface modification, dissolution and purge steps may each be performed at (or near) atmospheric pressure and room temperature. Performing the processing steps within the same process chamber at roughly the same temperature and pressure decreases the cycle time and improves the throughput of the wet ALE process described herein by avoiding unnecessary chamber transitions and temperature/pressure changes.

It is noted, however, that the embodiments described herein are not strictly limited to only atmospheric pressure and room temperature, nor are they limited to a particular process chamber. In other embodiments, one or more of the surface modification, dissolution and purge steps can be run at above atmospheric pressure in a pressure vessel, or at reduced pressure in a vacuum chamber. Etch solutions can be dispensed in these environments as long as the vapor pressure of the liquid is lower than the chamber pressure. For these implementations, a spinner with a liquid dispensing nozzle would be placed in the pressure vessel or vacuum chamber. The temperature of the liquid being dispensed can be elevated to any temperature below its boiling point at the pressure of the process. In one example implementation, the dissolution step may be performed at 100° C. as shown in FIGS. 3A and 3B. As noted above, higher liquid temperatures can increase the kinetics of dissolution.

Figure 9:
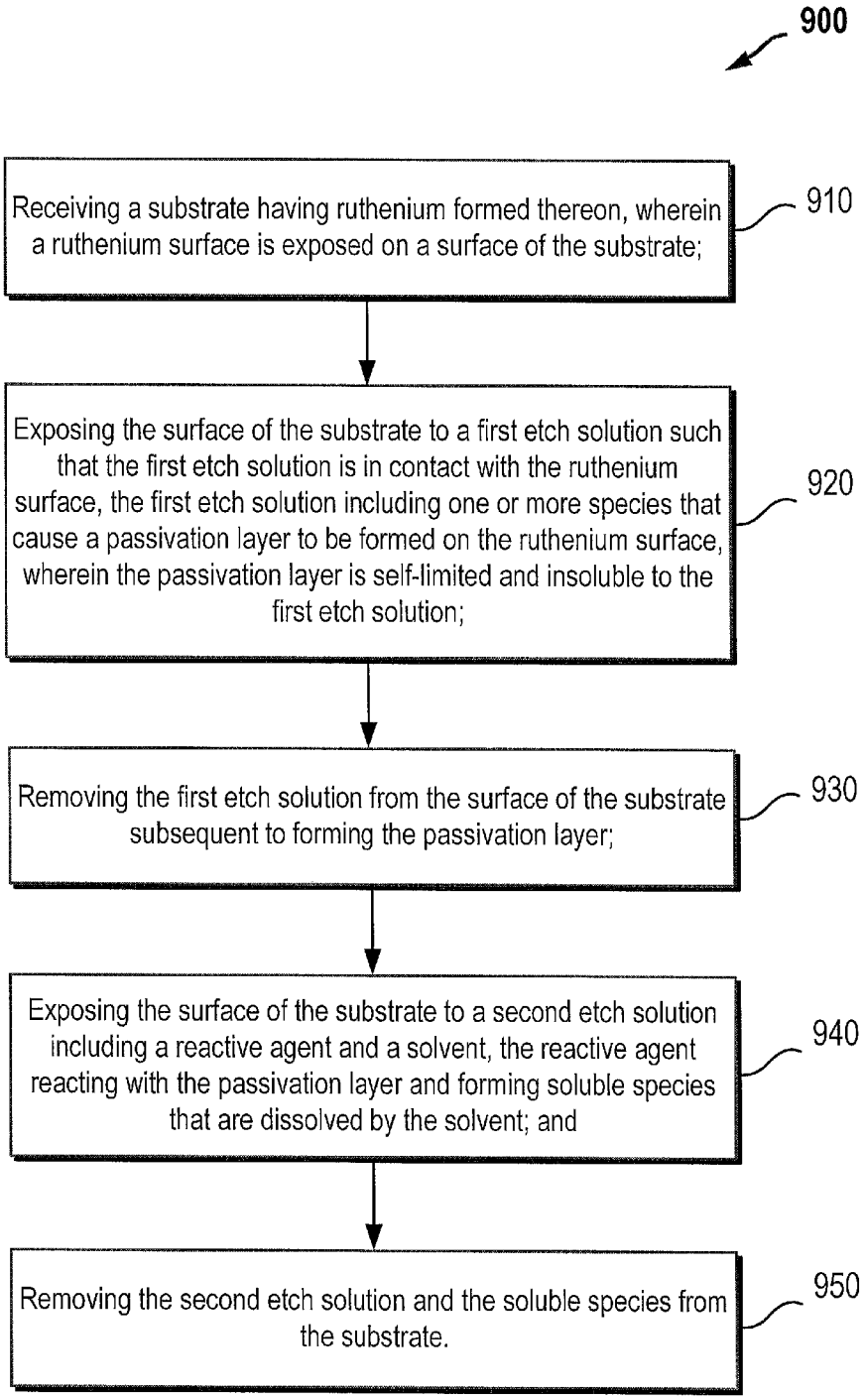
FIG. 9 is a flowchart diagram illustrating one embodiment of a method utilizing the techniques described herein.
Figure 10:
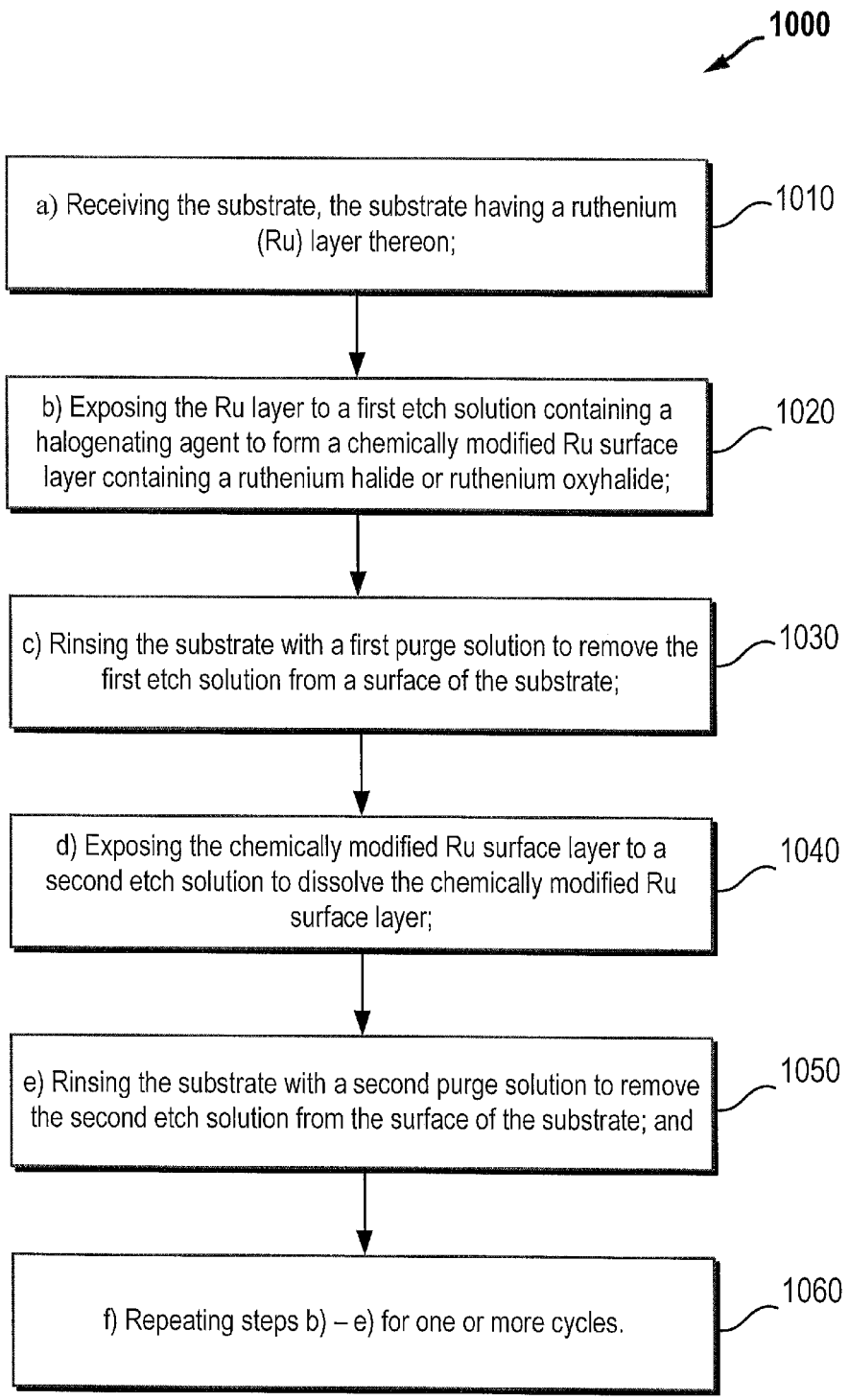
FIG. 10 is a flowchart diagram illustrating another embodiment of a method utilizing the techniques described herein.
Figure 11:
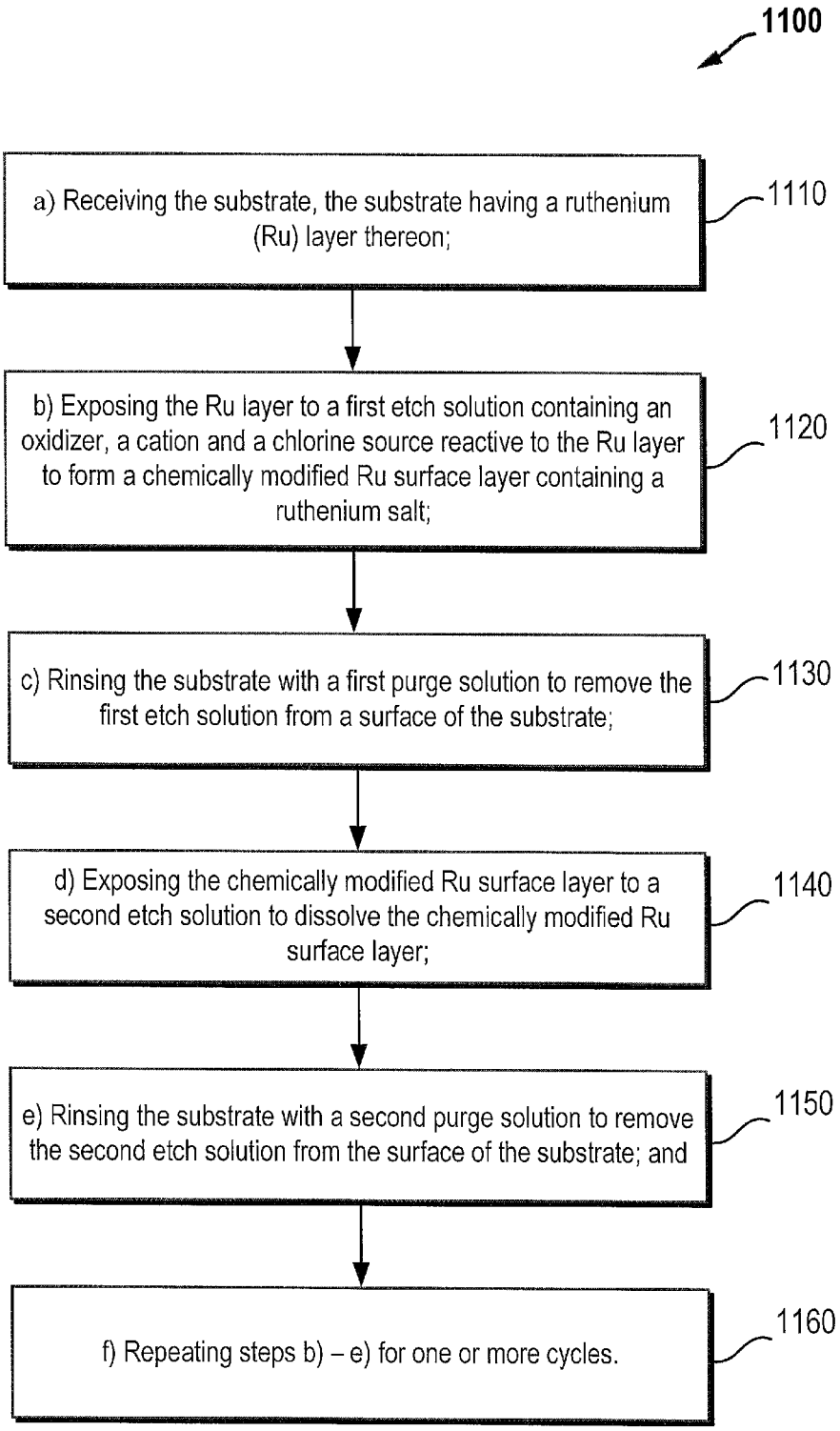
FIG. 11 is a flowchart diagram illustrating yet another embodiment of a method utilizing the techniques described herein.

FIGS. 9-11 illustrate exemplary methods that utilize the ruthenium etch chemistries described herein for etching ruthenium in a wet ALE process. It will be recognized that the embodiments of FIGS. 9-11 are merely exemplary and additional methods may utilize the techniques described herein. Further, additional processing steps may be added to the methods shown in the FIGS. 9-11 as the steps described are not intended to be exclusive. Moreover, the order of the steps is not limited to the order shown in the figures as different orders may occur and/or various steps may be performed in combination or at the same time.

FIG. 9 illustrates one embodiment of a method 900 of etching. The method 900 shown in FIG. 9 may generally include receiving a substrate having ruthenium formed thereon, wherein a ruthenium surface is exposed on a surface of the substrate (in step 910), and exposing the surface of the substrate to a first etch solution such that the first etch solution is in contact with the ruthenium surface (in step 920). The first etch solution may generally include one or more species that cause a passivation layer to be formed on the ruthenium surface in step 920. The passivation layer is self-limited and insoluble to the first etch solution. Next, the method 900 may include removing the first etch solution from the surface of the substrate subsequent to forming the passivation layer (in step 930) and exposing the surface of the substrate to a second etch solution including a reactive agent and a solvent (in step 940). The reactive agent reacts with the passivation layer and forms soluble species that are dissolved by the solvent in step 940. Next, the method 900 may include removing the second etch solution and the soluble species from the substrate (in step 950).

In some embodiments, the method 900 may further include repeating the steps of exposing the surface of the substrate to the first etch solution (in step 920), removing the first etch solution (in step 930), exposing the surface of the substrate to the second etch solution (in step 940), and removing the second etch solution (in step 950) a number of cycles until a predetermined amount of the ruthenium is removed from the substrate.

A variety of different etch chemistries may be used in the first etch solution and the second etch solution. In some embodiments, the one or more species in the first etch solution may include a halogenation agent dissolved in a first solvent. For example, the halogenation agent may include a chlorination agent, a fluorinating agent or a brominating agent. The halogenation agent chemically modifies the ruthenium surface to form a halogenated ruthenium passivation layer. In some embodiments, the first etch solution may include a chlorination agent, such as trichloroisocyanuric acid (TCCA), oxalyl chloride, thionyl chloride or N-chlorosuccinimide, and the first solvent may include ethyl acetate (EA), acetone, acetonitrile, or a chlorocarbon. In some embodiments, the halogenated ruthenium passivation layer may include ruthenium trichloride ($RuCl_3$).

In some embodiments, the reactive agent in the second etch solution may be a ligand species, which reacts with and binds to the halogenated ruthenium passivation layer to form the soluble species that are dissolved by the solvent. In some embodiments, the ligand species may include ethylenediaminetetraacetic acid (EDTA), iminodiacetic acid (IDA), diethylenetriaminepentaacetic acid (DTPA) or acetylacetone (ACAC), and the solvent in the second etch solution may include a base.

In other embodiments, the one or more species in the first etch solution may include an oxidizer, a cation and a chlorine source reactive to the ruthenium. In such embodiments, the passivation layer formed on the ruthenium surface in step 920 may include a ruthenate salt or a perruthenate salt. In one embodiment, the chlorine source may include hydrochloric acid (HCl). In such an embodiment, an oxidation amount of the passivation layer formed in step 920 may be controlled by the concentration of the hydrochloric acid in the first etch solution.

FIG. 10 illustrates one embodiment of a method 1000 that may be used for etching a substrate using a wet atomic layer etching (ALE) process. The method 1000 shown in FIG. 10 may generally include: a) receiving the substrate, the substrate having a ruthenium (Ru) layer thereon (in step 1010); b) exposing the Ru layer to a first etch solution containing a halogenating agent to form a chemically modified Ru surface layer containing a ruthenium halide or a ruthenium oxyhalide (in step 1020); c) rinsing the substrate with a first purge solution to remove the first etch solution from a surface of the substrate (in step 1030); d) exposing the chemically modified Ru surface layer to a second etch solution to dissolve the chemically modified Ru surface layer (in step 1040); e) rinsing the substrate with a second purge solution to remove the second etch solution from the surface of the substrate (in step 1050); and f) repeating steps b)-e) for one or more cycles (in step 1060).

In some embodiments, the first etch solution used in step 1020 may include a chlorination agent dissolved in a first solvent. For example, the chlorination agent may include trichloroisocyanuric acid (TCCA), oxalyl chloride, thionyl chloride or N-chlorosuccinimide, and the first solvent may include ethyl acetate (EA), acetone, acetonitrile, or a chlorocarbon. In such embodiments, the chlorination agent may react with the Ru layer to form a ruthenium chloride.

In some embodiments, the second etch solution used in step 1040 may include a ligand dissolved in a second solvent. For example, the ligand may include ethylenediaminetetraacetic acid (EDTA), iminodiacetic acid (IDA), diethylenetriaminepentaacetic acid (DTPA) or acetylacetone (ACAC), and the second solvent may include a base. In such embodiments, the ligand may react with and bind to the chemically modified Ru surface layer to form a soluble species that dissolves within the second solvent.

FIG. 11 illustrates one embodiment of a method 1100 that may be used for etching a substrate using a wet atomic layer etching (ALE) process. The method 1100 shown in FIG. 11 may generally include: a) receiving the substrate, the substrate having a ruthenium (Ru) layer thereon (in step 1110); b) exposing the Ru layer to a first etch solution containing an oxidizer, a cation and a chlorine source reactive to the Ru layer to form a chemically modified Ru surface layer containing a ruthenium salt (in step 1120); c) rinsing the substrate with a first purge solution to remove the first etch solution from a surface of the substrate (in step 1130); d) exposing the chemically modified Ru surface layer to a second etch solution to dissolve the chemically modified Ru surface layer (in step 1140); e) rinsing the substrate with a second purge solution to remove the second etch solution from the surface of the substrate (in step 1150); and f) repeating steps b)-e) for one or more cycles (in step 1160).

In some embodiments, the chlorine source within the first etch solution may include hydrochloric acid (HCl). In some embodiments, the oxidizer within the first etch solution may include ammonium persulfate (APS) or tetrabutylammonium peroxymonosulfate (TBAPMS). In some embodiments, the cation within the first etch solution may include tetramethylammonium (TMA+), tetraalkyl ammonium, phosphonium, pyridinium, pyrrolidinium, or sulfonium ions. In some embodiments, the first etch solution may further include a salt, wherein the salt comprises tetramethyl ammonium chloride (TMAC) or 1-butyl-3-methylimidizolium chloride.

In some embodiments, the chemically modified Ru surface layer may be insoluble in the first etch solution and soluble in the second etch solution. In such embodiments, the second etch solution may include trichlorobenzene.

In some embodiments, the chemically modified Ru surface layer may be insoluble in the first etch solution, and the method 1100 may further include using ion exchange to improve the solubility of the chemically modified Ru surface layer. In such embodiments, the second etch solution may include potassium chloride (KCl) and potassium hydroxide (KOH).

It is noted that reference throughout this specification to "one embodiment" or "an embodiment" means that a particular feature, structure, material, or characteristic described in connection with the embodiment is included in at least one embodiment of the invention, but do not denote that they are present in every embodiment. Thus, the appearances of the phrases "in one embodiment" or "in an embodiment" in various places throughout this specification are not necessarily referring to the same embodiment of the invention. Furthermore, the particular features, structures, materials, or characteristics may be combined in any suitable manner in one or more embodiments. Various additional layers and/or structures may be included and/or described features may be omitted in other embodiments.

The term "substrate" as used herein means and includes a base material or construction upon which materials are formed. It will be appreciated that the substrate may include a single material, a plurality of layers of different materials, a layer or layers having regions of different materials or different structures in them, etc. These materials may include semiconductors, insulators, conductors, or combinations thereof. For example, the substrate may be a semiconductor substrate, a base semiconductor layer on a supporting structure, a metal electrode or a semiconductor substrate having one or more layers, structures or regions formed thereon. The substrate may be a conventional silicon substrate or other bulk substrate comprising a layer of semi-conductive material. As used herein, the term "bulk substrate" means and includes not only silicon wafers, but also silicon-on-insulator ("SOI") substrates, such as silicon-on-sapphire ("SOS") substrates and silicon-on-glass ("SOG") substrates, epitaxial layers of silicon on a base semiconductor foundation, and other semiconductor or optoelectronic materials, such as silicon-germanium, germanium, gallium arsenide, gallium nitride, and indium phosphide. The substrate may be doped or undoped.

Systems and methods for processing a substrate are described in various embodiments. The substrate may include any material portion or structure of a device, particularly a semiconductor or other electronics device, and may, for example, be a base substrate structure, such as a semiconductor substrate or a layer on or overlying a base substrate structure such as a thin film. Thus, substrate is not intended to be limited to any particular base structure, underlying layer or overlying layer, patterned or unpatterned, but rather, is contemplated to include any such layer or base structure, and any combination of layers and/or base structures.

One skilled in the relevant art will recognize that the various embodiments may be practiced without one or more of the specific details, or with other replacement and/or additional methods, materials, or components. In other instances, well-known structures, materials, or operations are not shown or described in detail to avoid obscuring aspects of various embodiments of the invention. Similarly, for purposes of explanation, specific numbers, materials, and configurations are set forth in order to provide a thorough understanding of the invention. Nevertheless, the invention may be practiced without specific details. Furthermore, it is understood that the various embodiments shown in the figures are illustrative representations and are not necessarily drawn to scale.

Further modifications and alternative embodiments of the described systems and methods will be apparent to those skilled in the art in view of this description. It will be recognized, therefore, that the described systems and methods are not limited by these example arrangements. It is to be understood that the forms of the systems and methods herein shown and described are to be taken as example embodiments. Various changes may be made in the implementations. Thus, although the ruthenium wet ALE techniques are described herein with reference to specific embodiments, various modifications and changes can be made without departing from the scope of the present disclosure. Accordingly, the specification and figures are to be regarded in an illustrative rather than a restrictive sense, and such modifications are intended to be included within the scope of the present disclosure. Further, any benefits, advantages, or solutions to problems that are described herein with regard to specific embodiments are not intended to be construed as a critical, required, or essential feature or element of any or all the claims.

What is claimed is:

1. A method of etching, the method comprising:

receiving a substrate having ruthenium formed thereon, wherein a ruthenium surface is exposed on a surface of the substrate;

exposing the surface of the substrate to a first etch solution such that the first etch solution is in contact with the ruthenium surface, wherein the first etch solution includes a halogenation agent dissolved in a first solvent, and wherein the halogenation agent chemically modifies the ruthenium surface to form a halogenated ruthenium passivation layer on the ruthenium surface, wherein the halogenated ruthenium passivation layer is self-limited and insoluble to the first etch solution;

removing the first etch solution from the surface of the substrate subsequent to forming the halogenated ruthenium passivation layer;

exposing the surface of the substrate to a second etch solution including a reactive agent and a second solvent, wherein the reactive agent is a ligand species, which reacts with and binds to the halogenated ruthenium passivation layer to form soluble species that are dissolved by the second solvent; and removing the second etch solution and the soluble species from the substrate.

2. The method of claim 1, wherein the halogenation agent comprises a chlorination agent, a fluorinating agent or a brominating agent.

3. The method of claim 1, wherein the first etch solution includes a chlorination agent comprising trichloroisocyanuric acid (TCCA), oxalyl chloride, thionyl chloride or N-chlorosuccinimide.

4. The method of claim 1, wherein the first solvent comprises ethyl acetate (EA), acetone, acetonitrile, or a chlorocarbon.

5. The method of claim 1, wherein the halogenated ruthenium passivation layer comprises ruthenium trichloride ($RuCl_3$).

6. The method of claim 1, wherein the second solvent in the second etch solution includes a base.

7. The method of claim 1, wherein the ligand species include ethylenediaminetetraacetic acid (EDTA), iminodiacetic acid (IDA), diethylenetriaminepentaacetic acid (DTPA) or acetylacetone (ACAC), and wherein the solvent in the second etch solution includes a base.

8. The method of claim 1, further comprising repeating said exposing the surface of the substrate to the first etch solution, removing the first etch solution, exposing the surface of the substrate to the second etch solution, and removing the second etch solution a number of cycles until a predetermined amount of the ruthenium is removed from the substrate.

9. A method of etching, the method comprising:

receiving a substrate having ruthenium formed thereon, wherein a ruthenium surface is exposed on a surface of the substrate;

exposing the surface of the substrate to a first etch solution such that the first etch solution is in contact with the ruthenium surface, the first etch solution including one or more species that cause a passivation layer to be formed on the ruthenium surface, wherein the passivation layer is self-limited and insoluble to the first etch solution, and wherein the one or more species in the first etch solution include an oxidizer, a cation and a chlorine source reactive to the ruthenium;

removing the first etch solution from the surface of the substrate subsequent to forming the passivation layer;

exposing the surface of the substrate to a second etch solution including a reactive agent and a solvent, the reactive agent reacting with the passivation layer and forming soluble species that are dissolved by the solvent; and removing the second etch solution and the soluble species from the substrate.

10. The method of claim 9, wherein the passivation layer includes a ruthenate salt or a perruthenate salt.

11. The method of claim 9, wherein the chlorine source includes hydrochloric acid, and wherein an oxidation amount of the passivation layer is controlled by concentration of the hydrochloric acid in the first etch solution.

12. The method of claim 9, further comprising repeating said exposing the surface of the substrate to the first etch solution, removing the first etch solution, exposing the surface of the substrate to the second etch solution, and removing the second etch solution a number of cycles until a predetermined amount of the ruthenium is removed from the substrate.

13. A method of etching a substrate using a wet atomic layer etching (ALE) process, the method comprising:

a) receiving the substrate, the substrate having a ruthenium (Ru) layer thereon;

b) exposing the Ru layer to a first etch solution containing a halogenating agent to form a chemically modified Ru surface layer containing a ruthenium halide or a ruthenium oxyhalide;

c) rinsing the substrate with a first purge solution to remove the first etch solution from a surface of the substrate;

d) exposing the chemically modified Ru surface layer to a second etch solution to dissolve the chemically modified Ru surface layer, wherein the second etch solution includes a ligand dissolved in a second solvent, wherein the ligand reacts with and binds to the chemically modified Ru surface layer to form a soluble species that dissolves within the second solvent;

e) rinsing the substrate with a second purge solution to remove the second etch solution from the surface of the substrate; and f) repeating steps b)-e) for one or more cycles.

14. The method of claim 13, wherein the first etch solution includes a chlorination agent dissolved in a first solvent, wherein the chlorination agent reacts with the Ru layer to form a ruthenium chloride.

15. The method of claim 14, wherein the chlorination agent comprises trichloroisocyanuric acid (TCCA), oxalyl chloride, thionyl chloride or N-chlorosuccinimide, and wherein the first solvent comprises ethyl acetate (EA), acetone, acetonitrile, or a chlorocarbon.

16. The method of claim 14, wherein the ligand comprises ethylenediaminetetraacetic acid (EDTA), iminodiacetic acid (IDA), diethylenetriaminepentaacetic acid (DTPA) or acetylacetone (ACAC), and wherein the second solvent comprises a base.

17. A method of etching a substrate using a wet atomic layer etching (ALE) process, the method comprising:

a) receiving the substrate, the substrate having a ruthenium (Ru) layer thereon;

b) exposing the Ru layer to a first etch solution containing an oxidizer, a cation and a chlorine source reactive to the Ru layer to form a chemically modified Ru surface layer containing a ruthenium salt;

c) rinsing the substrate with a first purge solution to remove the first etch solution from a surface of the substrate;

d) exposing the chemically modified Ru surface layer to a second etch solution to dissolve the chemically modified Ru surface layer;

e) rinsing the substrate with a second purge solution to remove the second etch solution from the surface of the substrate; and f) repeating steps b)-e) for one or more cycles.

18. The method of claim 17, wherein the chlorine source within the first etch solution includes hydrochloric acid (HCl).

19. The method of claim 17, wherein the oxidizer within the first etch solution includes ammonium persulfate (APS) or tetrabutylammonium peroxymonosulfate (TBAPMS), and wherein the cation within the first etch solution comprises tetramethylammonium (TMA+), tetraalkyl ammonium, phosphonium, pyridinium, pyrrolidinium, or sulfonium ions.

20. The method of claim 17, wherein the first etch solution further includes a salt, and wherein the salt comprises tetramethyl ammonium chloride (TMAC) or 1-butyl-3-methylimidizolium chloride.

21. The method of claim 17, wherein the chemically modified Ru surface layer is insoluble in the first etch solution and soluble in the second etch solution.

22. The method of claim 21, wherein the second etch solution includes trichlorobenzene.

23. The method of claim 17, wherein the chemically modified Ru surface layer is insoluble in the first etch solution, and wherein the method further comprises using ion exchange to improve the solubility of the chemically modified Ru surface layer.

24. The method of claim 23, wherein the second etch solution includes potassium chloride (KCl) and potassium hydroxide (KOH).

* * * * *